US008849133B2

(12) United States Patent
Itabashi et al.

(10) Patent No.: US 8,849,133 B2
(45) Date of Patent: Sep. 30, 2014

(54) IMAGE FORMING APPARATUS AND CARTRIDGE THEREFOR

(71) Applicants: Nao Itabashi, Nagoya (JP); Naoya Kamimura, Ichinomiya (JP)

(72) Inventors: Nao Itabashi, Nagoya (JP); Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 49 days.

(21) Appl. No.: 13/628,220

(22) Filed: Sep. 27, 2012

(65) Prior Publication Data

US 2013/0084083 A1 Apr. 4, 2013

(30) Foreign Application Priority Data

Sep. 29, 2011 (JP) ..... 2011-214609

(51) Int. Cl.
*G03G 15/00* (2006.01)
*G03G 21/00* (2006.01)
*G03G 21/18* (2006.01)

(52) U.S. Cl.
CPC ..... *G03G 21/1896* (2013.01); *G03G 21/1875* (2013.01)
USPC ..... 399/12; 399/90; 399/111; 399/119

(58) Field of Classification Search
USPC ..... 399/12, 13, 90, 111, 119, 262
See application file for complete search history.

(56) References Cited

U.S. PATENT DOCUMENTS 7,085,509 B2 8/2006 Kubota et al.
7,174,113 B2 2/2007 Kubota et al.
7,978,997 B2 7/2011 Tokuda
2005/0135832 A1 6/2005 Kubota et al.
2006/0110181 A1 5/2006 Kubota et al.
2007/0059018 A1 3/2007 Tokuda
2011/0211866 A1* 9/2011 Hashimoto ..... 399/119
2011/0243578 A1* 10/2011 Ukai et al. ..... 399/12
2011/0293294 A1* 12/2011 Eto ..... 399/12
2013/0084082 A1 4/2013 Itabashi et al.
2013/0084084 A1 4/2013 Itabashi et al.

FOREIGN PATENT DOCUMENTS

CN 201464807 5/2010
EP 1542096 A1 6/2005
JP 2007-079284 A 3/2007

OTHER PUBLICATIONS

European Search Report issued in European Patent Application No. 12186091.0 mailed on Jan. 2, 2014.
European Search Report issued in European Patent Application No. 12186096.9 mailed on Jan. 2, 2014.

(Continued)

*Primary Examiner* — Sophia S Chen
(74) *Attorney, Agent, or Firm* — Banner & Witcoff, Ltd.

(57) ABSTRACT

An image forming apparatus and a cartridge to be used therein. The image forming apparatus includes a main casing, a CPU, and a main electrode. The cartridge accommodating therein toner is attachable to and detachable from the main casing, and has a cartridge electrode electrically connectable to the main electrode, a moving member and a pressure member. The CPU is configured to judge assembly or non-assembly of the cartridge with respect to the main casing and to judge whether or not the assembled cartridge is a new cartridge. The moving member is movable by a predetermined moving amount to permit the pressure member to be movable. The cartridge electrode is movable in accordance with the movement of the pressure member. As a result of a movement of the main electrode in accordance with the movement of the cartridge electrode, the CPU determines that the assembled cartridge is a new cartridge.

19 Claims, 13 Drawing Sheets

(56) References Cited

OTHER PUBLICATIONS

European Search Report issued in European Patent Application No. 12186071.2 mailed on Jan. 2, 2014.

Non-Final Office Action received in corresponding U.S. Appl. No. 13/628,168 mailed May 27, 2014.

Non-Final Office Action received in corresponding U.S. Appl. No. 13/628,526 mailed May 21, 2014.

* cited by examiner

IMAGE FORMING APPARATUS AND CARTRIDGE THEREFOR

CROSS REFERENCE TO RELATED APPLICATION

This application claims priority from Japanese Patent Application No. 2011-214609 filed Sep. 29, 2011. The entire content of the priority application is incorporated herein by reference. The present application closely relates to a co-pending US patent application (based on Japanese patent application No. 2011-214625 filed Sep. 29, 2011) and another co-pending US patent application (based on Japanese patent application No. 2011-214655 filed Sep. 29, 2011) which are incorporated herein by reference.

TECHNICAL FIELD

The present invention relates to an electro-photographic type image forming apparatus, and to a cartridge to be used in the image forming apparatus.

BACKGROUND

As an electro-photographic type image forming apparatus, a printer including a photosensitive body and a developing cartridge configured to supply toner to the photosensitive body is known.

A conventional printer is provided with a detection device for detecting information of the developing cartridge assembled therein, for example, for detecting whether or not the cartridge is a brand new cartridge.

Japanese Patent Application Publication No. 2007-79284 discloses a detection structure having a detection projection as the detection device. The detection projection is made from an electrically conductive resin and is provided at a side surface of the developing cartridge. The projection is in abutment with an actuator in a main casing of the printer.

The detection structure is covered by a gear cover, and is irreversibly displaceable from a new cartridge position to an old cartridge position. The detection projection is accommodated in the gear cover in case of the new cartridge position. Upon receipt of a driving force from a drive source in the main casing, the detection projection is exposed to an outside through an opening of the gear cover while the detection structure is displaced from the new cartridge position to the old cartridge position.

SUMMARY

According to the printer disclosed in the publication, the actuator in the main casing is required to be positioned such that the detection projection is abutted on the actuator in case of the old cartridge position.

In other words, the detection projection is required to be positioned within a limited region of the cartridge such that the driving force is transmittable to the detection structure while the actuator is required to be positioned within a limited region of the main casing such that the actuator is abuttable on the detection projection. Hence, there may be a case where the degree of freedom is decreased in designing the printer.

It is therefore an object of the present invention to provide an image forming apparatus having an enhanced degree of freedom in design and a cartridge to be assembled thereto.

In order to attain the above and other objects, the present invention provides an image forming apparatus including: a main casing; a cartridge; a pressed portion; a detection unit; and a judgment unit. The cartridge is configured to be attached to and detached from the main casing and to accommodate therein developing agent. The pressed portion is positioned outside of the cartridge. The detection unit is positioned in confrontation with the cartridge in a confronting direction and configured to detect a position of the cartridge. The judgment unit is configured to judge that a cartridge attached to the main casing is a new cartridge based on a detection of the detection unit. The cartridge includes: a detected portion; a pressure member; and a moving member. The detected portion is configured to be detected by the detection unit. The detected portion is configured to be moved to a first position and to a second position moved from the first position in the confronting direction. The pressure member is configured to press against the pressed portion and to be moved to a pressure position where the detected portion is moved to the second position by a reaction force in response to a pressure force from the pressure member against the pressed portion and to a pressure release position where the reaction force applied to the pressed portion is released to permit the detected portion to be moved to the first position. The moving member is configured to be moved in a moving direction by a predetermined moving amount. The moving member is configured to move the pressure member to the pressure position and to the pressure release position. The judgment unit makes a judgment that the cartridge attached to the main casing is a new cartridge if the detection unit detects a movement of the detected portion.

According to another aspect, the present invention provides a cartridge including: a cartridge frame; a drive input portion; a detected portion; a pressure member; and a moving member. The cartridge frame is configured to accommodate therein developing agent. The cartridge frame includes a first side wall and a second side wall spaced away therefrom and in confrontation therewith in a confronting direction. The drive input portion is provided at one of the first side wall and the second side wall and configured to receive an external driving force. The detected portion is provided at one of the first side wall and the second side wall and configured to be detected by an external detection unit. The detected portion is configured to be moved to a first position and to a second position moved from the first position in the confronting direction. The pressure member is provided at the second side wall and configured to press against an external pressed portion. The pressure member is configured to be moved to a pressure position where the detected portion is moved to the second position by a reaction force in response to a pressure force from the pressure member against the external pressed portion and to a pressure release position where the reaction force applied to the external pressed portion is released to permit the detected portion to be moved to the first position. The moving member is provided at the second side wall and configured to be moved in a moving direction by a predetermined moving amount upon transmission of a driving force inputted in the drive input portion. The moving member is configured to move the pressure member to the pressure position and to the pressure release position.

BRIEF DESCRIPTION OF THE DRAWINGS

In the drawings;

FIGS. 5A and 5B are views for description of movement of a pressure member, which is a component of the developing cartridge of FIG. 3, in a new cartridge detecting operation; and in which FIG. 5A shows a state prior to a warm-up operation where the pressure member is at a pressure release position; and FIG. 5B shows a state of the warm-up operation where the pressure member is at a pressure position;

FIGS. 6A and 6B are views for description of movement of a cartridge electrode which is a component of the developing cartridge of FIG. 3, a main electrode, and an actuator in the new cartridge detecting operation; and in which FIG. 6A shows the state prior to the warm-up operation where the cartridge electrode is at a first position, the main electrode is at a retracted position, and the actuator is at a light shielding position, and FIG. 6B shows the state of the warm-up operation where the cartridge electrode is at a second position, the main electrode is at an advanced position, and the actuator is at a light transmitting position;

FIGS. 7A through 7C are views for description of movement of a pressure member, which is a component of a developing cartridge according to a second embodiment of the present invention, in a new cartridge detecting operation; and in which FIG. 7A shows a state prior to a warm-up operation where the pressure member is at a pressure release position, and FIG. 7B shows a state of the warm-up operation where the pressure member is at a pressure position, and FIG. 7C shows a state after the warm-up operation where the pressure member is at the pressure release position;

FIGS. 9A and 9B are views for description of pressure members which are components of a developing cartridge according to a fourth embodiment of the present invention, in which FIG. 9A shows the developing cartridge, and FIG. 9B shows a moving member and the pressure members of FIG. 9A;

FIGS. 11A and 11B are views for description of movement of the developing cartridge of FIG. 10 in a new cartridge detecting operation; and in which FIG. 11A shows a state prior to a warm-up operation where a pressure member is at a pressure release position and a light shielding plate is at a first position, and FIG. 11B shows a state of the warm-up operation where the pressure member is at a pressure position and a light shielding plate is at a second position;

FIGS. 12A and 12B are views for description of a first modification of the light shielding plate of the developing cartridge according to the fifth embodiment; and in which FIG. 12A shows a state where a light shielding plate according to the first modification (without an elongated hole) is positioned at a first position, and FIG. 12B shows a state where the light shielding plate is positioned at a second position;

FIGS. 13A and 13B are views for description of a second modification of the light shielding plate of the developing cartridge according to the fifth embodiment; and in which FIG. 13A shows a state where a light shielding plate according to the second modification (having a mirror) is positioned at a first position, and FIG. 13B shows a state where the light shielding plate is positioned at a second position.

DETAILED DESCRIPTION

A color printer as an image forming apparatus according to a first embodiment of the present invention will be described with reference to FIGS. 1 through 6B. Throughout the specification, the terms "upward", "downward", "upper", "lower", "above", "below", "beneath", "right", "left", "front", "rear" and the like will be used assuming that the image forming apparatus is disposed in an orientation in which it is intended to be used. More specifically, in FIG. 1 a left side and a right side are a front side and a rear side, respectively.

1. Overall Structure of Color Printer

Figure 1:
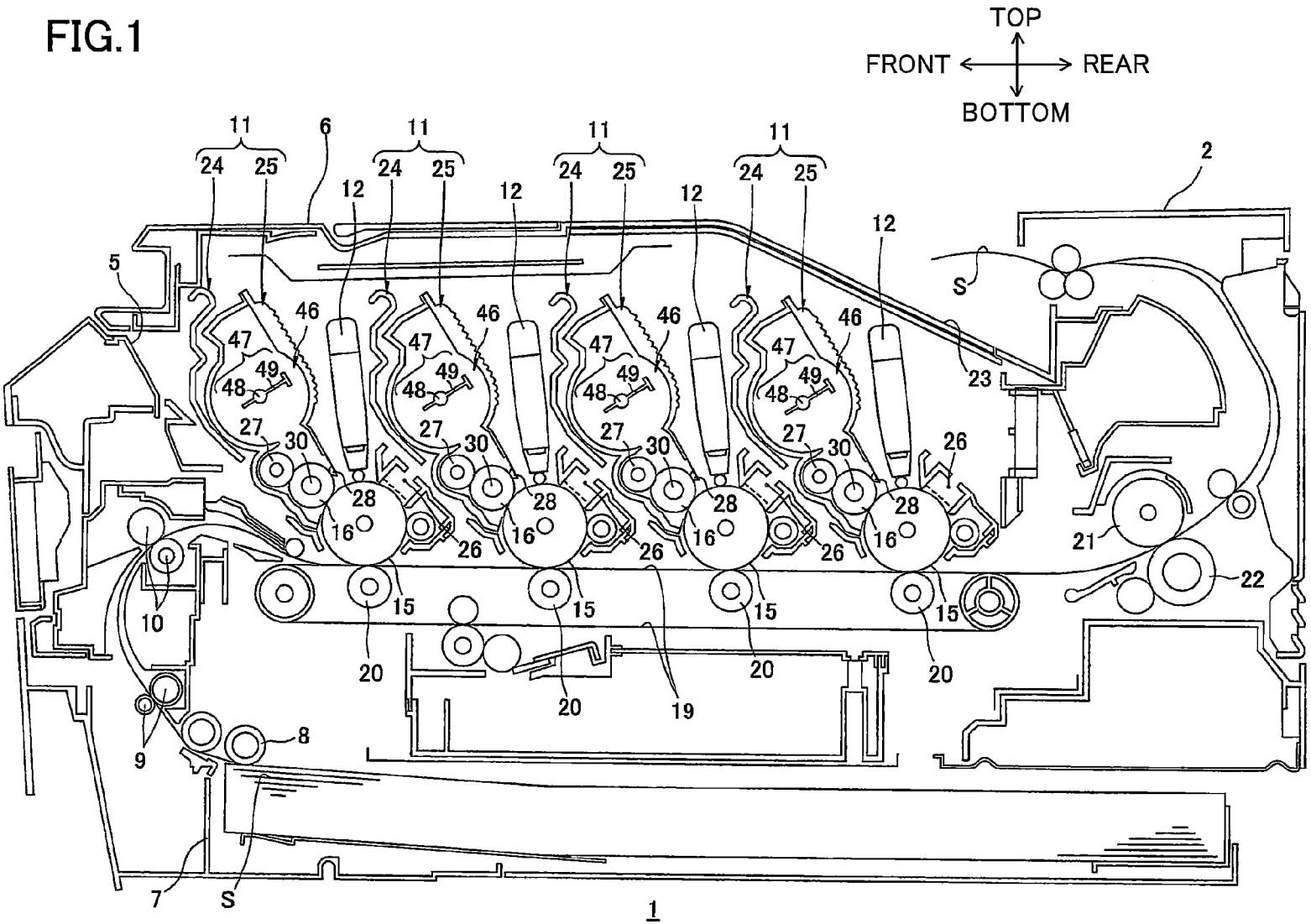
FIG. 1 is a cross-sectional view of a printer according to a first embodiment of the present invention.

Referring to FIG. 1, the printer 1 is a horizontal direct tandem type color printer. The printer 1 includes a main casing 2 having a generally box shape. The main casing 2 has an upper portion provided with a top cover 6 which can be opened or closed for opening and closing an opening 5. The top cover 6 has a rear end portion pivotally movably supported to the main casing 2. The printer 1 includes four process cartridges 11 corresponding to colors different from each other.

Each process cartridge 11 is detachable and attachable relative to the main casing 2. When mounted, the process cartridges 11 are juxtaposedly arrayed in the frontward/rearward direction within the main casing 2 at intervals. Each process cartridge 11 includes a drum cartridge 24 and a developing cartridge 25 detachable from and attachable to the drum cartridge 24.

Each drum cartridge 24 has a photosensitive drum 15. The photosensitive drum 15 is cylindrical in shape and extends in a lateral direction (rightward/leftward direction), and is rotatably supported to a frame of the drum cartridge 24.

The developing cartridge 25 has a developing roller 16 which has a developing roller shaft 30 extending in the lateral direction and made from metal. The developing roller 16 has a rear side exposed to an outside through a rear end portion of a frame of the developing cartridge 25. The developing roller 16 is positioned diagonally above and frontward of the photosensitive drum 15 and in contact therewith.

The developing cartridge 25 is provided with a supply roller 27, a layer thickness regulation blade 28, a toner chamber 46, and an agitator 47. The supply roller 27 is adapted to supply toner to the developing roller 16. The layer thickness regulation blade 28 is adapted to regulate a thickness of a toner layer supplied to the developing roller 16. The toner chamber 46 is positioned above the supply roller 27 and the layer thickness regulation blade 28, and the agitator 47 is provided in the toner chamber 46 for agitating the toner. The agitator 47 includes an agitation shaft 48 extending in the lateral direction and agitation blades 49 extending radially outwardly from the agitation shaft 48.

Toner accommodated in the toner chamber 46 is subjected to tribo-electric charging to have a positive polarity between the supply roller 27 and the developing roller 16. The toner is carried on an outer peripheral surface of the developing roller 16 in a form of a thin toner layer having a uniform thickness by the layer thickness regulation blade 28.

A scorotron charger 26 and an LED unit 12 are provided in confrontation with each photosensitive drum 15. After an outer peripheral surface of the photosensitive drum 15 is uniformly charged by the scorotron charger 26, the surface is exposed to light by the LED unit 12 based on a predetermined image data to form an electrostatic latent image on the surface. Then, a visible toner image (developing agent image) corresponding to the electrostatic latent image is formed on the outer peripheral surface of the photosensitive drum 15 by supplying toner carried on the developing roller 16 to the corresponding photosensitive drum 15.

A sheet cassette 7 is provided at a bottom portion of the main casing 2 for accommodating sheets S therein in a stacked state. Each sheet S accommodated in the sheet cassette 7 is passed through a U-shaped passage and is conveyed to a position between the photosensitive drum 15 and a conveyor belt 19 at a prescribed timing by a pickup roller 8, a sheet supply roller 9 and a pair of registration rollers 10. Then, each sheet S is conveyed rearward by the conveyer belt 19 at a position between each photosensitive drum 15 and each transfer roller 20. The toner image formed on the outer peripheral surface of each photosensitive drum 15 is sequentially transferred and superimposed onto the sheet S, thereby providing a color image on the sheet S.

The sheet S on which the color image has been formed is then conveyed to a fixing unit provided downstream of the conveyer belt 19. The fixing unit includes a heat roller 21 and a pressure roller 22. The color image is thermally fixed to the sheet S when the sheet S passes through the heat roller 21 and the pressure roller 22. The sheet S carrying the color image is then conveyed through an U-shaped passage frontward and upward, and is discharged onto a discharge tray 23 provided at the top cover 6.

2. Details of Developing Cartridge

Figure 2A:
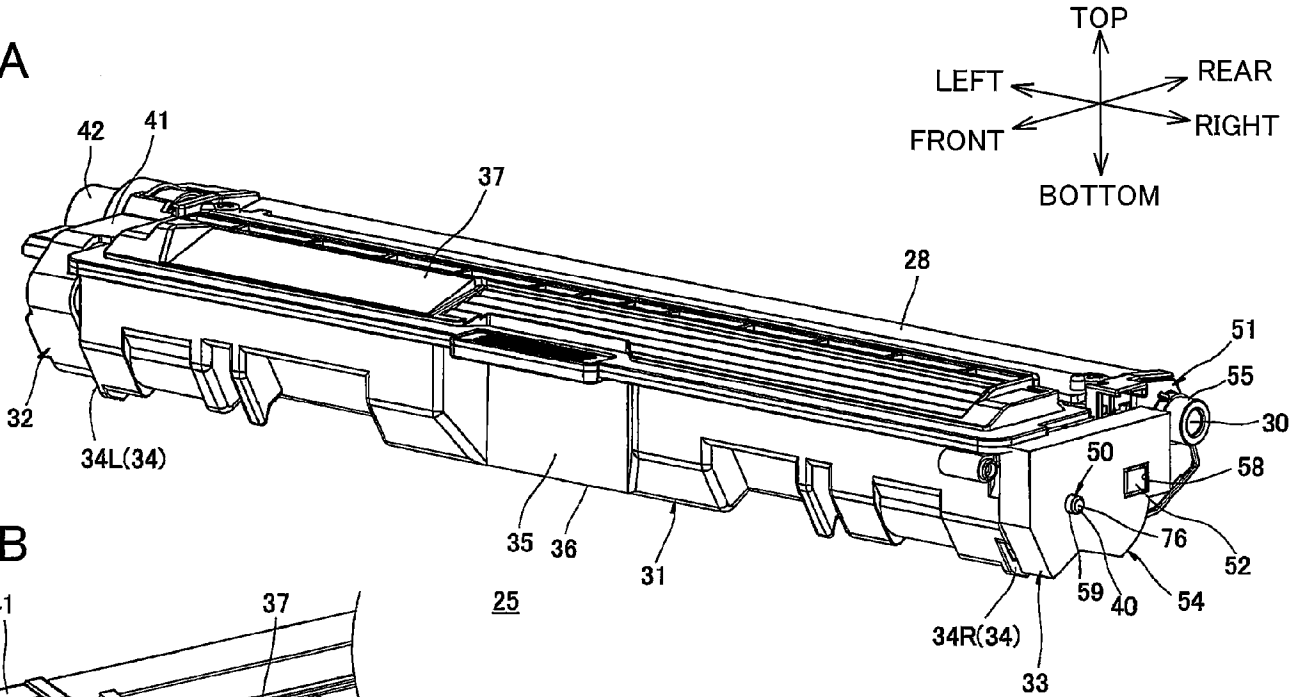
FIG. 2A is a perspective view of a developing cartridge accommodated in the printer shown in FIG. 1 as viewed from a diagonally front right side.
Figure 2B:
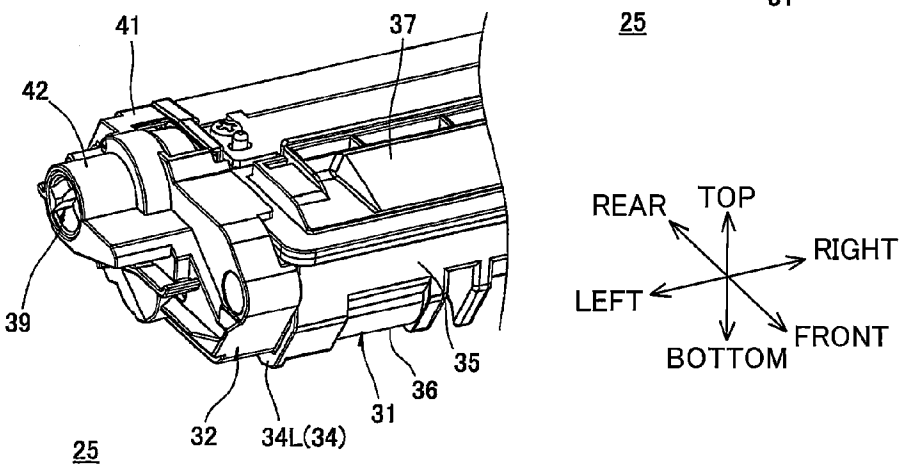
FIG. 2B is a partial perspective view of a left end portion of the developing cartridge of FIG. 2A as viewed from a diagonally front left side.
Figure 3:
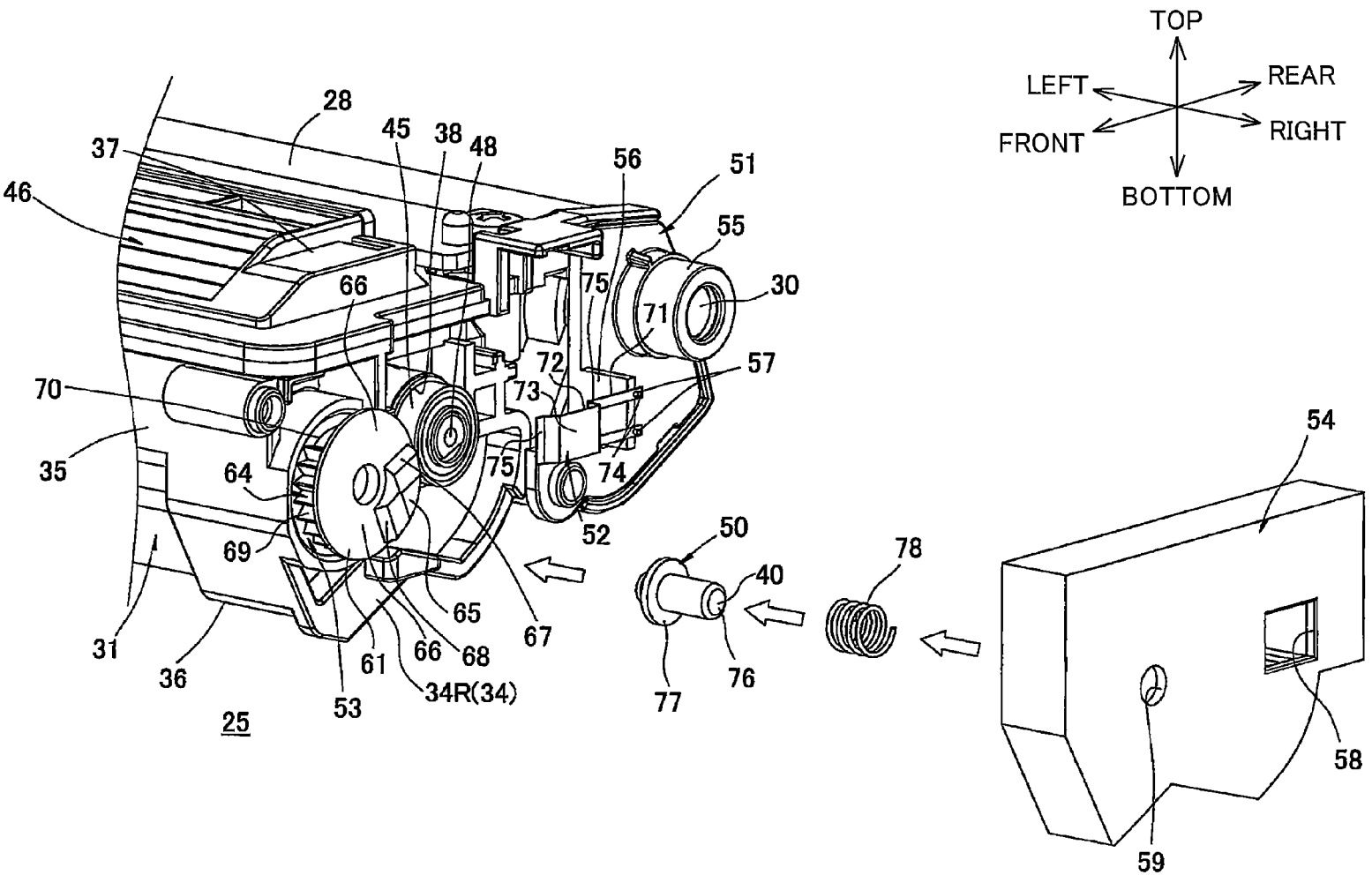
FIG. 3 is a partial perspective view of the developing cartridge of FIG. 2A as viewed from a diagonally front right side and without a power supply side cover.

As shown in FIGS. 2A, 2B and 3, the developing cartridge 25 includes a cartridge frame 31, a drive unit 32 positioned at a left side of the cartridge frame 31, and a power supply unit 33 positioned at a right side of the cartridge frame 31.

Throughout the description of the developing cartridge 25, regarding "direction", a side at which the developing roller 16 is positioned will be referred to as a "rear side" of the developing cartridge 25, and a side at which the thickness regulation blade 28 is positioned will be referred to as an "upper side" of the developing cartridge 25. That is, a "frontward/rearward direction" with respect to the developing cartridge 25 is different from the "frontward/rearward direction" with respect to the printer 1. More specifically, the developing cartridge 25 is assembled to the drum cartridge 24 and to the printer 1 such that the rear side and the front side of the developing cartridge 25 will correspond to a "lower rear side" and an "upper front side" of the printer 1.

(1) Cartridge Frame

The cartridge frame 31 extends in the lateral direction (confronting direction) and is generally box shaped. The cartridge frame 31 includes a pair of side walls 34, a front wall 35, a lower wall 36 and an upper wall 37. The pair of side walls 34 includes a left side wall 34L and a right side wall 34R.

Each side wall 34 extends in the frontward/rearward direction and in the vertical direction, and is generally rectangular shaped in a side view. The pair of side walls 34 is spaced away from each other in the lateral direction, and each side wall 34 is formed with an agitator shaft exposure hole 38 that exposes the agitation shaft 48 to the outside.

The agitator shaft exposure hole 38 is positioned at a generally center portion of the side wall 34 in the frontward/rearward direction and is generally circular shaped in a side view. The agitator shaft exposure hole 38 is penetrated through a thickness of the side wall 34 and has a diameter greater than an outer diameter of each lateral end portion of the agitation shaft 48. Each lateral end portion of the agitation shaft 48 extends through the agitator shaft exposure hole 38 and protrudes laterally outward from the side wall 34. An agitator gear 45 is fixedly (non-rotatably) coupled to each lateral end portion of the agitator shaft 48.

The front wall 35 extends in the lateral direction and is spanned between front end portions of the side walls 34. The lower wall 36 extends in the lateral direction and is spanned between lower end portions of the side walls 34 such that the lower wall 36 is connected to a lower end portion of the front wall 35. The upper wall 37 extends in the lateral direction and is spanned between upper end portions of the side walls 34 such that the upper wall 37 is connected to an upper end portion of the front wall 35. The upper wall 37 has a rear end portion at which the layer thickness regulation blade 28 is positioned such that the layer thickness regulation blade 28 is in contact with the developing roller 16 from above.

(2) Drive Unit

As shown in FIG. 2B, the drive unit 32 includes a drive side cover 41 which extends in the lateral direction with its leftmost end being closed. The drive side cover 41 is hollow prismatic body shaped, and is provided with a collar portion 42. The collar portion 42 is positioned at a generally center portion of the drive side cover 41 in the frontward/rearward direction, and protrudes leftward therefrom. The collar portion 42 is generally hollow cylindrical shaped with its right end portion being in communication with an internal space of the drive side cover 41.

A generally cylindrical developing coupling 39 extending in the lateral direction is positioned within and supported to the collar portion 42 such that the developing coupling 39 is rotatable relative to the collar portion 42. The developing coupling 39 has a left end portion exposed to the outside from a left end portion of the collar portion 42. The left end portion of the developing coupling 39 is fitted with a main coupling (not shown) provided to the main casing 2 such that relative rotation therebetween is prevented. A driving force from the main casing 2 is transmitted to the developing coupling 39 through the main coupling. Further, the driving force is transmitted, through a gear train (not shown), to the developing roller shaft 30 of the developing roller 16, a shaft of the supply roller 27, and the agitator shaft 48. The developing coupling 39 is provided at the left side wall 34L, but may be provided at the right side wall 34R.

(3) Power Supply Unit

As shown in FIGS. 2A and 3, the power supply unit 33 includes a bearing member 51, a cartridge electrode 52, a moving member 53, a pressure member 50 and a power supply side cover 54.

(3-1) Bearing Member

The bearing member 51 is assembled to a right side of the right side wall 34R at the rear end portion of the developing cartridge 25. The bearing member 51 is made from an electrically conductive resin, and is generally rectangular plate shaped in a side view. The bearing member 51 includes a developing roller shaft support portion 55 and an electrode support portion 56.

The developing roller shaft support portion 55 is positioned at a rear end portion of the bearing member 51 and is generally hollow cylindrical shaped extending rightward from a right side surface of the bearing member 51. The developing roller shaft support portion 55 has an inner diameter approximately equal to or greater than an outer diameter of a right end portion of the developing roller shaft 30. Further, the bearing member 51 is formed with an opening (not shown) coaxial with the developing roller shaft support portion 55 and having a diameter equal to the inner diameter of the developing roller shaft support portion 55. The right end portion of the developing roller shaft 30 extends through and is rotatably supported to the developing roller shaft support portion 55.

The electrode support portion 56 is positioned at a front end portion of the bearing member 51. The electrode support portion 56 is generally flat plate shaped, protruding rightward from the right side surface of the bearing member 51 and extending in the vertical direction. The electrode support portion 56 has a right end portion provided with two support bosses 57 adapted to support the cartridge electrode 52.

The two support bosses 57 are in confrontation with and spaced away from each other in the vertical direction. Each support boss 57 is generally cylindrical shaped, protruding rightward from the right side surface of the electrode support portion 56.

(3-2) Cartridge Electrode

The cartridge electrode 52 is made from a material with rigidity and electrical conductivity, such as metal. The cartridge electrode 52 is adapted to be electrically connected to a main electrode 81 (FIGS. 6A, 6B, described later) at a side of the main casing 2. The cartridge electrode 52 integrally includes a power supplied portion 72 and two supported portions 71.

The power supplied portion 72 is generally U-shaped in a plan view with its left end being open. More specifically, the power supplied portion 72 integrally includes a main portion 73 and two leg portions 75. The main portion 73 is generally rectangular shaped in a side view and extends in the frontward/rearward direction (orthogonal direction). The two leg portions 75 are bent (curved) leftward from front and rear end portions of the main portion 73, respectively. One of the leg portions 75 positioned at a front side will be referred to as a front leg portion 75 and remaining one of the leg portions 75 positioned at a rear side will be referred to as a rear leg portion 75. Incidentally, the main portion 73 has a generally center portion in the frontward/rearward direction with which the main electrode 81 (described later) is contacted when the developing cartridge 25 is mounted in the main casing 2 (FIG. 6B).

The two supported portions 71 are spaced away from each other in the vertical direction and connected to a rear end portion of the power supplied portion 72. Each supported portion 71 is generally beam shaped and extends rearward from a left end portion of the rear end portion of the power supplied portion 72 (more specifically, a left end portion of the rear leg portion 75). Each supported portion 71 has a vertical length smaller than that of the power supplied portion 72. Further, each supported portion 71 has a rear end portion formed with a fitting hole 74. The fitting hole 74 is penetrated through a thickness of the supported portion 71. Each support boss 57 of the bearing member 51 extends through the corresponding fitting hole 74.

The support bosses 57 are respectively fitted in the fitting holes 74, so that the cartridge electrode 52 is supported to the electrode support portion 56 of the bearing member 51.

(3-3) Moving Member

Figure 4A:
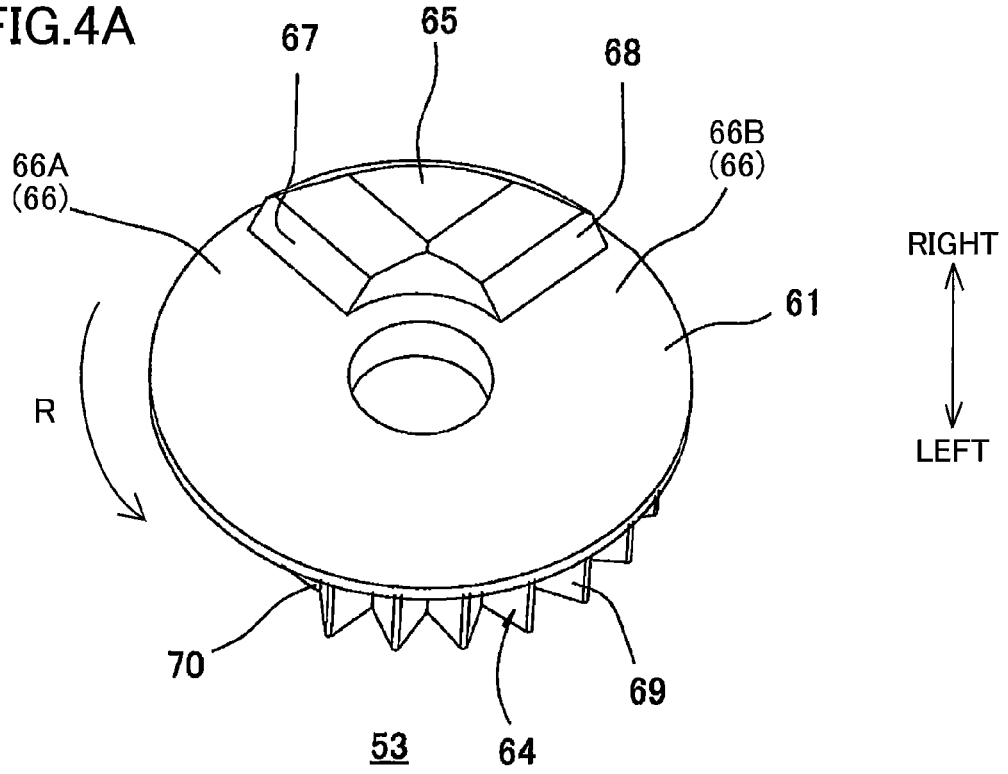
FIG. 4A is a perspective view of a moving member which is a component of the developing cartridge of FIG. 3 as viewed from a right side.
Figure 4B:
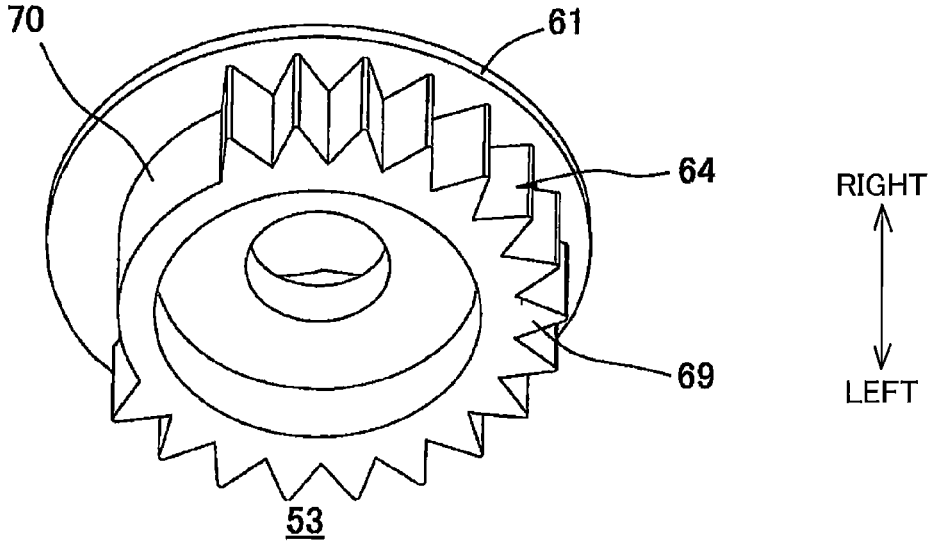
FIG. 4B is a perspective view of the moving member as viewed from a left side.

As shown in FIG. 3, the moving member 53 is positioned frontward of the agitator gear 45. As shown in FIGS. 4A and 4B, the moving member 53 integrally includes a base portion 61, a projection 65, and a chipped gear 64 (gear teeth is partly lacking).

The base portion 61 has a thickness in the lateral direction and is generally circular disc shaped whose center portion is formed with a through-hole.

The projection 65 protrudes rightward from a right side surface of the base portion 61 and is sector shaped in a side view whose center angle is 90 degrees. A recessed portion 66 is recessed leftward from the projection 65 and positioned beside a downstream side and an upstream side of the projection 65 in the counterclockwise direction in a right side view. The recessed portion 66 includes a first recessed portion 66A positioned at the downstream side of the projection 65 in the counterclockwise direction in a right side view and a second recessed portion 66B positioned at the upstream side of the projection 65 in the counterclockwise direction in a right side view. The projection 65, the first recessed portion 66A, the second recessed portion 66B are arrayed in a circumferential direction of the base portion 61.

The projection 65 is defined by a first end face 67 and a second end face 68. The first end face 67 is positioned downstream of the second end face 68 in the counterclockwise direction in a right side view. The first end face 67 is inclined diagonally rightward in a direction from the downstream end to the upstream end of the first end face 67 in the counterclockwise direction in a right side view. The second end face 68 is inclined diagonally leftward in a direction from the downstream end to the upstream end of the second end face 68 in the counterclockwise direction in a right side view.

The chipped gear 64 is generally cylindrical shaped extending leftward from a left side surface of the base portion 61. The chipped gear 64 is concentric with the base portion 61. Gear teeth are provided such that an array of the gear teeth along the circumferential direction of the base portion 61 has a center angle of 270 degrees. Incidentally, in the chipped gear 64, a portion where teeth are provided will be referred to as a toothed portion 69, and a portion where teeth are not provided will be referred to as a toothless portion 70.

The moving member 53 is supported to the right side wall 34R at a right side thereof and is rotatable about an axis of the base portion 61 in a counterclockwise direction, indicated as a rotation direction R in FIG. 4A. In a state where the developing cartridge 25 is a new cartridge (not in use), the chipped gear 64 is in meshing engagement with the agitator gear 45 from front at a downstream end portion of the toothed portion 69 in the counterclockwise direction in a right side view. In this case, the projection 65 is positioned at a rear end portion of the moving member 53.

(3-4) Pressure Member

Figure 5A:
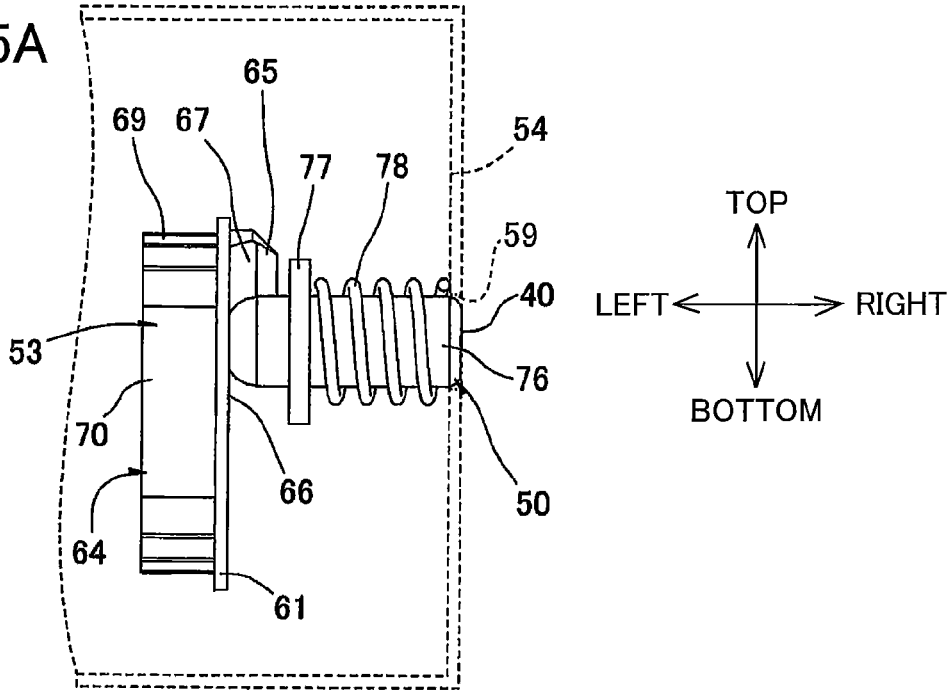
Figure 5B:
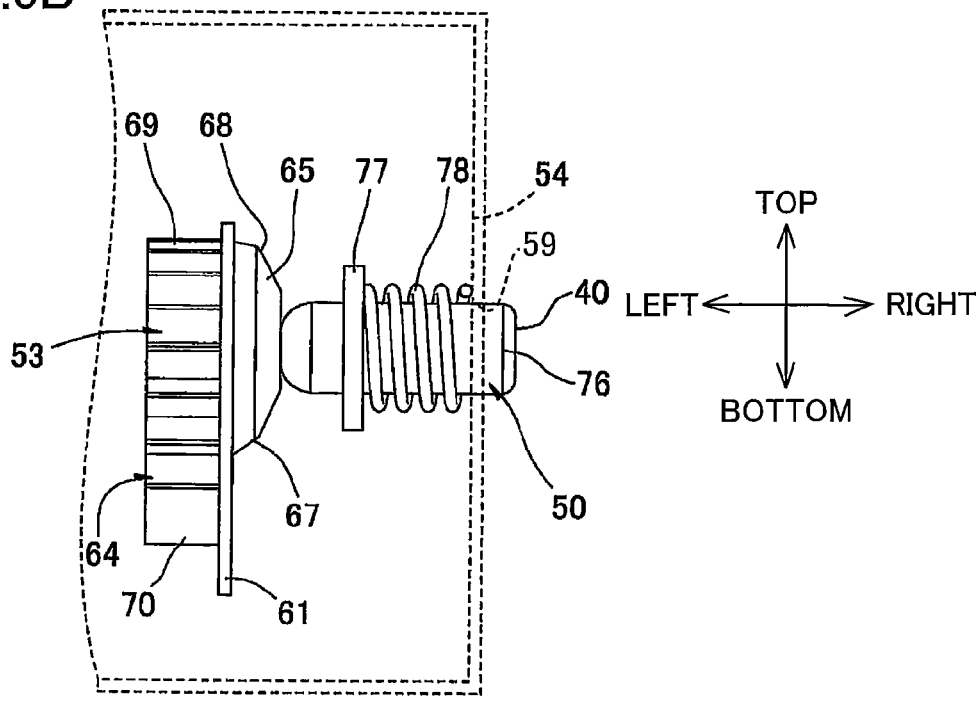

As shown in FIGS. 3, 5A and 5B, the pressure member 50 integrally includes a shaft portion 76 and a flange portion 77.

The shaft portion 76 is generally cylindrical shaped extending in the lateral direction. The shaft portion 76 has a right side surface 40 extending in the frontward/rearward direction and in the vertical direction so as to be orthogonal to the lateral direction.

The flange portion 77 is provided at a left end portion of the shaft portion 76. The flange portion 77 protrudes radially outwardly from an outer circumferential surface of the shaft portion 76. The flange portion 77 is annular shaped in a side view and coaxial with the shaft portion 76.

The shaft portion 76 is positioned between the moving member 53 and the power supply side cover 54 such that the shaft portion 76 confronts a pressure member exposure opening 59 (described later) formed in the power supply side cover 54.

With this configuration, the pressure member 50 is movable between a pressure release position (FIG. 5A) and a pressure position (FIG. 5B). In the pressure release position, the left end portion of the shaft portion 76 is in confrontation with the recessed portion 66 of the moving member 53 while the right end portion of the shaft portion 76 does not protrude rightward from the pressure member exposure opening 59 (described later) formed in the power supply side cover 54. In the pressure position, the left end portion of the shaft portion 76 is in confrontation with the projection 65 of the moving member 53 while the right end portion of the shaft portion 76 protrudes rightward through the pressure member exposure opening 59 (described later) formed in the power supply side cover 54.

A compression spring 78 is loosely fitted with the pressure member 50. The compression spring 78 has a generally coil-like configuration and extends in the lateral direction. The compression spring 78 is fitted radially onto the pressure member 50 such that the compression spring 78 surrounds a portion of the shaft 76 positioned rightward from the flange portion 77.

Incidentally, the compression spring 78 is positioned between a right side surface of the flange portion 77 and a left side surface of the power supply side cover 54, thereby normally urging the pressure member 50 leftward.

(3-5) Power Supply Side Cover

As shown in FIG. 2, the power supply side cover 54 is generally rectangular shaped in a side view, whose right end portion is closed. The power supply side cover 54 is adapted to cover the right end portion of the developing cartridge 25 so as to cover the cartridge electrode 52 and the moving member 53. The power supply side cover 54 is formed with a cartridge electrode exposure opening 58 for exposing the cartridge electrode 52 to the outside and the pressure member exposure opening 59 for exposing the pressure member 50 to the outside.

The cartridge electrode exposure opening 58 is positioned at a rear end portion of the power supply side cover 54, and has a generally rectangular shape in a side view. The cartridge electrode exposure opening 58 is penetrated through a thickness of the power supply side cover 54. In a state where the developing cartridge 25 is a new cartridge, the cartridge electrode 52 is exposed to the outside through the cartridge electrode exposure opening 58 such that a right side surface of the main portion 73 is generally flush with a right side surface of the power supply side cover 54.

The pressure member exposure opening 59 is positioned at a front end portion of the power supply side cover 54 and at a front side of the cartridge electrode exposure opening 58. The pressure member exposure opening 59 is generally circular shaped in a side view. The pressure member exposure opening 59 is penetrated through a thickness of the power supply side cover 54 and has a diameter greater than an outer diameter of the shaft portion 76 of the pressure member 50.

3. Drum Cartridge

Figure 6A:
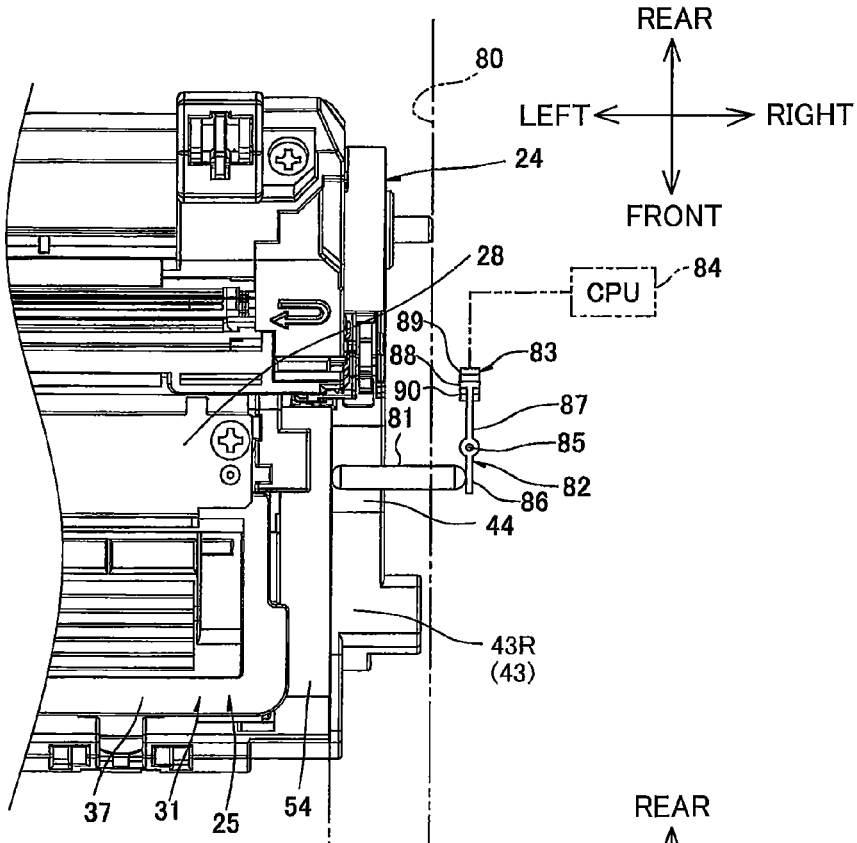
Figure 6B:
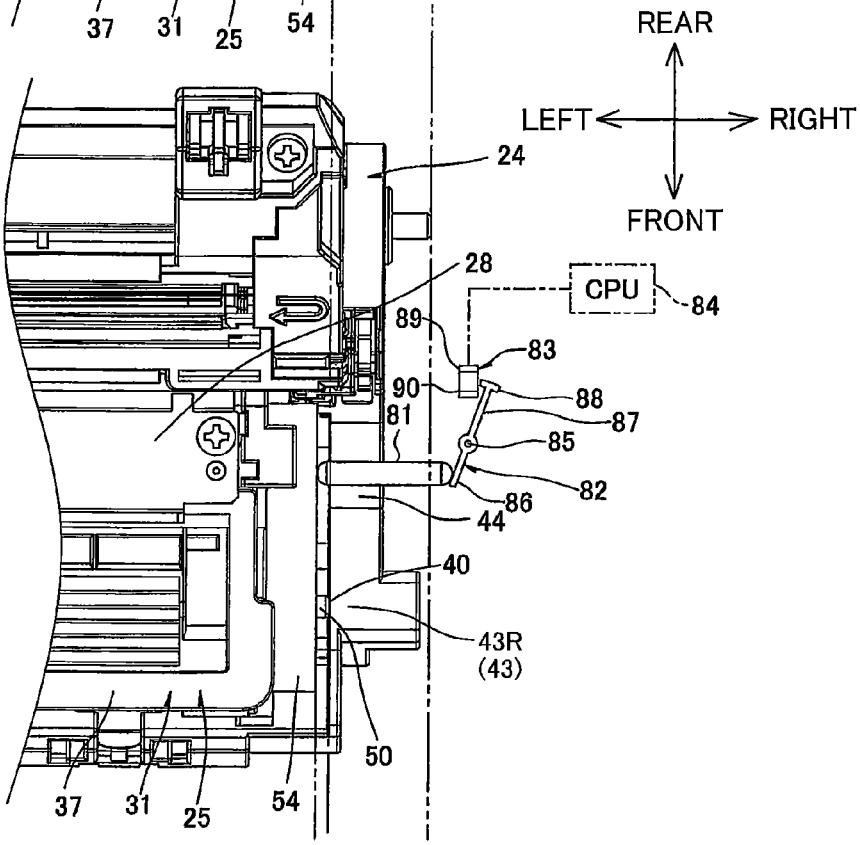

As shown in FIGS. 6A and 6B, the drum cartridge 24 is generally rectangular frame shaped and extends in the lateral direction. The drum cartridge 24 is capable of accommodating the developing cartridge 25 therein.

The drum cartridge 24 includes a pair of side plates 43. The pair of side plates 43 is in confrontation with each other in the lateral direction and positioned laterally outward of the developing cartridge 25. The side plate 43 positioned at a right side will be referred to as the right side plate 43R. Each side plate 43 has a thickness in the lateral direction and is generally flat plate shaped extending in the frontward/rearward direction. Incidentally, the right side plate 43R functions as a pressed portion confronting a right side of the developing cartridge 25. Further, each side plate 43 is formed with an exposure recess 44 for exposing the developing coupling 39 and the cartridge electrode 52 to the outside in the lateral direction.

The exposure recess 44 is generally U-shaped in a side view such that the exposure recess 44 is cut out in a top edge of the side plate 43 at a generally center portion of the side plate 43 in the frontward/rearward direction and depressed downward from the top edge.

Incidentally, the drum cartridge 24 accommodates the developing cartridge 25 such that the developing cartridge 25 is slightly slidably movable in the lateral direction.

4. Main Casing

As shown in FIGS. 6A and 6B, the main electrode 81, an actuator 82, a photo-sensor 83 and a CPU 84 are provided within the main casing 2.

The main electrode 81 is positioned adjacent to the right side of the developing cartridge 25 when the developing cartridge 25 is mounted in the main casing 2. The main electrode 81 is made from metal. The main electrode 81 extends in the lateral direction and is generally cylindrical shaped. The main electrode 81 is supported to the main casing 2 and is slidably movable in the lateral direction between an advanced position as shown in FIG. 6B and a retracted position as shown in FIG. 6A. The advanced position is advanced leftward, and the retracted position is moved rightward from the advanced position. The main electrode 81 is electrically connected to a power source (not shown) in the main casing 2.

The actuator 82 integrally includes a pivot shaft 85, an abutment lever 86 and a light shielding lever 87. The pivot shaft 85 extends in the vertical direction and is generally hollow cylindrical shaped. The abutment lever 86 extends frontward from the pivot shaft 85. The light shielding lever 87 extends rearward from the pivot shaft 85. The light shielding lever 87 has a rear end portion provided with a light shielding plate 88 extending downward therefrom.

The actuator 82 is pivotally movably supported to the main casing 2 at a position adjacent to the right side of the developing cartridge 25 such that the abutment lever 86 is pivotally movable about the pivot shaft 85 so that the abutment lever 86 can be contacted with the right end of the main electrode 81.

More specifically, the actuator 82 is pivotally movable to a light transmitting position as shown in FIG. 6B and to a light shielding position as shown in FIG. 6A. In the light transmitting position, the abutment lever 86 is directed diagonally frontward and leftward and the light shielding lever 87 is directed diagonally rightward and rearward. In the light shielding position, the abutment lever 86 and the light shielding lever 87 are directed in the frontward/rearward direction. The actuator 82 is connected to an urging member (not shown) such as a spring so that the actuator 82 is normally urged to the light transmitting position (so that the actuator 82 is urged clockwise in a plan view).

The photo-sensor 83 includes a light emitting element 89 and a light receiving element 90. The light emitting element 89 is adapted to emit detection light. The light receiving element 90 is adapted to receive the detection light and positioned spaced away from and frontward of the light emitting element 89. The photo-sensor 83 is positioned at the rear side of the actuator 82 such that the light shielding plate 88 of the actuator 82 in the light shielding position is positioned between the light emitting element 89 and the light receiving element 90. A combination of the photo-sensor 83, the main electrode 81 and the actuator 82 constitutes a detection unit.

In the light shielding position of the actuator 82 (FIG. 6A), the light shielding plate 88 is positioned between the light emitting element 89 and the light receiving element 90, so that the detection light emitted from the light emitting element 89 is blocked by the light shielding plate 88. On the other hand, in the light transmitting position of the actuator 82 (FIG. 6B), the light shielding plate 88 is retracted rightward away from a gap between the light emitting element 89 and the light receiving element 90. Thus, the detection light emitted from the light emitting element 89 is received by the light receiving element 90, whereupon an ON signal is transmitted from the photo-sensor 83. The CPU 84 is provided in the main casing 2 and is electrically connected to the photo-sensor 83 so as to receive an ON signal from the photo-sensor 83.

5. Operation for Detecting New Developing Cartridge

An operation for detecting a new developing cartridge 25 will be described. When the process cartridge 11 (the developing cartridge 25) has not been assembled to the main casing 2, the actuator 82 is at the light transmitting position by the urging force of the urging member (not shown). Thus, the main electrode 81 is at the advanced position. In this case, the photo-sensor 83 transmits an ON signal to the CPU 84.

Upon receipt of the ON signal from the photo-sensor 83, the CPU 84 determines that the main electrode 81 is at the advanced position. Then, if this state continues for a predetermined time period (if the advanced position of the main electrode 81 is maintained for the predetermined time period), in other words, if the ON signal from the photo-sensor 83 is not interrupted within the predetermined time period, the CPU 84 determines that the developing cartridge 25 is not assembled to the main casing 2.

Then, the top cover 6 of the main casing 2 is opened to insert, from diagonally above and frontward into the main casing 2, the process cartridge 11 to which a new developing cartridge 25 is assembled. The main portion 73 of the cartridge electrode 52 is brought into contact with the left end portion of the main electrode 81, as shown in FIG. 6A.

Then, the main electrode 81 is pushed rightward from the advanced position to the retracted position against the urging force of the urging member (not shown) applied to the actuator 82, so that the actuator 82 is pivotally moved in the counterclockwise direction in a plan view from the light transmitting position to the light shielding position.

Thus, output of the ON signal from the photo-sensor 83 to the CPU 84 is interrupted. That is, the photo-sensor 83 detects the first position of the cartridge electrode 52 through the main electrode 81 and the actuator 82.

Then, the CPU 84 determines that the main electrode 81 has been moved from the advanced position to the retracted position due to interruption of the ON signal from the photo-sensor 83.

After assembly of the developing cartridge 25 into the main casing 2, the main coupling (not shown) in the main casing 2 is fitted with the developing coupling 39 of the drive unit 32, preventing relative rotation therebetween.

Then, the developing cartridge 25 is pushed rightward by the main coupling (not shown), thereby being subjected to positioning relative to the right side plate 43R of the drum cartridge 24. At the same time, the right side plate 43R of the drum cartridge 24 is subjected to positioning relative to a right side wall 80 of the main casing 2.

Thus, a driving force from the main casing 2 is transmitted to the developing coupling 39 through the main coupling (not shown) for starting a warm-up operation.

Then, a driving force from the developing coupling 39 is transmitted to the agitator shaft 48 through the gear train (not shown) to rotate the agitator 47.

As a result of rotation of the agitator 47, as shown in FIG. 3, a driving force from the agitator shaft 48 is transmitted to the toothed portion 69 of the chipped gear 64 of the moving member 53 through the agitator gear 45, so that the moving member 53 is rotated in the counterclockwise direction in a right side view.

Accordingly, as shown in FIGS. 5A and 5B, the pressure member 50 is moved along the inclined surface of the first end face 67 toward the projection 65, so that the pressure member 50 which has been in confrontation with the first recessed portion 66A is seated on the projection 65 such that the right end portion of the shaft portion 76 protrudes rightward through the pressure member exposure opening 59 formed in the power supply side cover 54 against the urging force of the compression spring 78. Thus, the pressure member 50 is positioned at the pressure position.

As a result, as shown in FIG. 6B, the pressure member 50 presses against an inner surface of the right side plate 43R of the drum cartridge 24 at the right end portion of the shaft portion 76, i.e. at the right side surface 40 of the shaft portion 76.

Then, the right end portion of the pressure member 50 is pressed leftward by a reaction force from the right side plate 43R of the drum cartridge 24, whereupon the developing cartridge 25 is entirely moved leftward against a pressure force from the main coupling (not shown). Consequently, the cartridge electrode 52 is moved leftward to the second position.

Simultaneously, the main electrode 81 is pushed leftward from the retraced position to the advanced position by the urging force of the urging member (not shown) applied to the actuator 82, so that the actuator 82 is pivotally moved in the clockwise direction in a plan view by the urging force of the urging member (not shown) to be moved from the light shielding position to the light transmitting position.

Thus, the photo-sensor 83 outputs an ON signal to the CPU 84. That is, the photo-sensor 83 detects the second position of the cartridge electrode 52 through the main electrode 81 and the actuator 82.

Then, the CPU 84 determines that the main electrode 81 has been moved from the retracted position to the advanced position upon receipt of the ON signal from the photo-sensor 83.

As a result of further rotation of the moving member 53 in the counterclockwise direction in a right side view, the pressure member 50 is moved relative to the moving member 53 in the clockwise direction in a right side view such that the pressure member 50 which has been seated on the projection 65 of the moving member 53 confronts the second recessed portion 66B of the moving member 53 which is positioned at the upstream side of the projection 65 in the counterclockwise direction in a right side view. In other words, the pressure member 50 can be moved leftward by a distance corresponding to a depth of the recessed portion 66.

The pressure member 50 is pushed leftward by the urging force of the compression spring 78 while moved along the inclined surface of the second end face 68 toward the second recessed portion 66B. Thus, the pressure member 50 is positioned at the pressure release position.

As a result, the pressure member 50 does not any more press against the right side plate 43R of the drum cartridge 24.

Then, the developing cartridge 25 is pushed rightward by a pressure force from the main coupling (not shown), thereby again being subjected to positioning relative to the right side plate 43R of the drum cartridge 24. Consequently, the cartridge electrode 52 is moved rightward to the first position.

Simultaneously, the main electrode 81 is pushed rightward from the advanced position to the retracted position against the urging force of the urging member (not shown) applied to the actuator 82, so that the actuator 82 is pivotally moved in the counterclockwise direction in a plan view to be moved from the light transmitting position to the light shielding position.

Thus, output of the ON signal from the photo-sensor 83 to the CPU 84 is interrupted. That is, the photo-sensor 83 detects the first position of the cartridge electrode 52 through the main electrode 81 and the actuator 82. Due to the interruption of the ON signal from the photo-sensor 83, the CPU 84 determines that the main electrode 81 has been moved from the advanced position to the retracted position.

In accordance with further rotation of the moving member 53 in the counterclockwise direction in a right side view, the toothless portion 70 of the chipped gear 64 of the moving member 53 is brought into confrontation with the agitator gear 45, releasing meshing engagement between the toothed portion 69 of the chipped gear 64 and the agitator gear 45. Thus, rotation of the moving member 53 is stopped to terminate the warm-up operation.

Further, upon supply of developing bias (electric power) from the power source in the main casing 2 to the cartridge electrode 52 through the main electrode 81, the developing bias is supplied to the developing roller shaft 30 through the bearing member 51.

The CPU 84 determines that the developing cartridge 25 is a new (unused) cartridge based on the detection of movement of the main electrode 81 from the retracted position to the advanced position and then from the advanced position to the retracted position after starting the warm-up operation.

After the determination, the CPU 84 counts printing times, and notifies and displays on an operation panel (not shown) an exchanging timing of the developing cartridge 25 when the counted printing times approaches a predetermined printing times (for example, 6000 sheets printing).

Incidentally, the CPU 84 determines assembly of the developing cartridge 25 into the main casing 2 when the ON signal from the photo-sensor 83 is interrupted within a predetermined time period (that is, when the main electrode 81 is judged to be at the retracted position).

On the other hand, there is a case where after the new developing cartridge 25 is assembled, the developing cartridge 25 is again assembled to the main casing 2 after being detached from the main casing 2, for example, for removing a jammed sheet S. In such a case, rotation of the moving member 53 is stopped while the toothless portion 70 of the chipped gear 64 confronts the agitator gear 45.

Therefore, in the re-assembly, rotation of the moving member 53 is not started even after starting the warm-up operation, and as a result, the new cartridge detection will not be carried out. In the latter case, because the cartridge electrode 52 stays at the first position, the CPU 84 does not receive an ON signal from the photo-sensor 83. Thus, the CPU 84 determines that the main electrode 81 is at the retracted position.

Accordingly, the CPU 84 determines that the developing cartridge 25 has been assembled into the main casing 2. Further, the CPU 84 determines that the re-assembled cartridge 25 is an old cartridge 25. Then, the CPU 84 continues comparison between the predetermined printing times and the accumulated total number of printing times from the timing at which the CPU 84 determines that the assembled developing cartridge 25 is a new cartridge.

6. Operations and Effects (1) According to the printer 1 and the developing cartridge 25 described above, as shown in FIGS. 6A and 6B, the cartridge electrode 52 is moved from the first position to the second position by the reaction force in response to the pressure force the pressure member 50 against the side plate 43 of the drum cartridge 24.

The cartridge electrode 52 can be moved by the reaction force regardless of the position of the cartridge electrode 52 in the developing cartridge 25 as long as the pressure member 50 is positioned in confrontation with the side plate 43 of the drum cartridge 24.

Accordingly, it is not required to provide the structure for moving the cartridge electrode 52 at a position adjacent thereto, which increases the degree of freedom in layout of the cartridge electrode 52. As a result, the degree of freedom in layout of the detection unit (the main electrode 81, the actuator 82, and the photo-sensor 83) for detecting the position of the cartridge electrode 52 can also be enhanced. Eventually, the degree of freedom in design of the printer 1 and the developing cartridge 25 can also be enhanced.

(2) Further, according to the printer 1, as shown in FIGS. 6A and 6B, conditions of the developing cartridge 25 can be detected by using the main electrode 81 configured to supply electric power to the cartridge electrode 52.

Accordingly, no additional component is required for the detection, which reduces the number of components of the developing cartridge 25.

(3) Further, according to the printer 1, with a simple construction, existence or non-existence of the developing cartridge 25 in the main casing 2 can be detected by detecting the position of the main electrode 81.

(4) Further, according to the printer 1 and the developing cartridge 25, as shown in FIG. 6B, the right side plate 43R of the drum cartridge 24 can be stably pressed by the right side surface 40 of the pressure member 50.

(5) Further, according to the printer 1 and the developing cartridge 25, as shown in FIG. 4A, the moving member 53 includes the projection 65 and the recessed portion 66 recessed leftward from the projection 65.

Accordingly, with a simple construction, the pressure member 50 can be moved in the lateral direction.

Further, the projection 65 defines by the first end face 67 that is inclined diagonally rightward from the downstream end toward the upstream end of the first end face 67 in the counterclockwise direction in a right side view.

Accordingly, the pressure member 50 can be smoothly moved rightward while moved along the first end face 67.

(6) Further, according to the printer 1 and the developing cartridge 25, as shown in FIG. 4B, the moving member 53 includes the chipped gear 64 provided with the toothed portion 69 and the toothless portion 70.

Accordingly, the moving member 53 can be reliably moved by a predetermined moving amount.

(7) Further, according to the printer 1 and the developing cartridge 25, the moving member 53 is rotatable in the counterclockwise direction in a right side view.

Accordingly, with a simple construction, the pressure member 50 can be stably moved.

(8) Further, according to the printer 1 and the developing cartridge 25, the pressure member 50 is in the pressure release position (FIG. 5A) prior to transmission of the driving force to the toothed portion 69. Upon transmission of the driving force to the toothed portion 69, the pressure member 50 is moved from the pressure release position to the pressure position (FIG. 5B), and then moved from the pressure position to the pressure release position.

Accordingly, the pressure member 50 can be moved to the pressure release position and to the pressure position while the moving member 53 is moved by the predetermined moving amount.

(9) Further, according to the printer 1 and the developing cartridge 25, as shown in FIGS. 5A and 5B, the developing cartridge 25 includes the compression spring 78 for urging the pressure member 50 leftward.

Accordingly, the pressure member 50 can be stably moved to the pressure release position.

7. Second Embodiment

A developing cartridge 125 according to a second embodiment of the present invention will next be described with reference to FIGS. 7A through 7C wherein like parts and components are designated by the same reference numerals as those shown in the first embodiment (FIGS. 1 through 6B) to avoid duplicating description.

(1) Structure of Second Embodiment

According to the first embodiment, the moving member 53 is in the form of generally circular disc shape, and is rotatable in the counterclockwise direction in a right side view. In contrast, according to the second embodiment, a moving member 96 is generally flat rectangular plate shaped, and is slidably and linearly movable in the frontward/rearward direction.

More specifically, a power supply unit 133 includes the moving member 96, a support rail 97 and a pinion gear 98. The moving member 96, the support rail 97, and the pinion gear 98 are positioned inside of the power supply side cover 54. The support rail 97 is adapted to slidably support the moving member 96 in the frontward/rearward direction. The pinion gear 98 is adapted to input a driving force to the moving member 96.

The moving member 96 is generally U-shaped in a side view with its front end being open, and includes a displacement portion 99, and a rack portion 100. The displacement portion 99 is generally rectangular plate shaped in a side view, and has a front end portion formed into an inclined surface where the surface is directed diagonally rightward and rearward.

The rack portion 100 is generally beam shaped extending frontward from a front lower end portion of the displacement portion 99. A front half portion of the rack portion 100 is provided with a toothed portion 91 at its upper surface, and a rear half portion of the rack portion 100 is a toothless portion 92.

The support rail 97 is fixed to an inner surface of the power supply side cover 54. The support rail 97 includes a pair of rail portions 95 confronting with each other and spaced away from each other in the vertical direction for slidably supporting upper and lower end portions of the moving member 96 such that an upper rail portion 95 is positioned above the upper end portion of the moving member 96 and a lower rail portion 95 is positioned below the lower end portion of the moving member 96.

The pinion gear 98 is fixed to the right end portion of the agitator shaft 48 at a position between the rail portions 95, 95, and is meshingly engageable with the front end portion of the toothed portion 91 of the rack portion 100 from above.

(2) Operation of Second Embodiment

Similar to the first embodiment, upon assembly of the process cartridge 11 to which the new developing cartridge 125 is assembled into the main casing 2, a warm-up operation is started, so that the agitator 47 starts rotating.

Figure 7A:
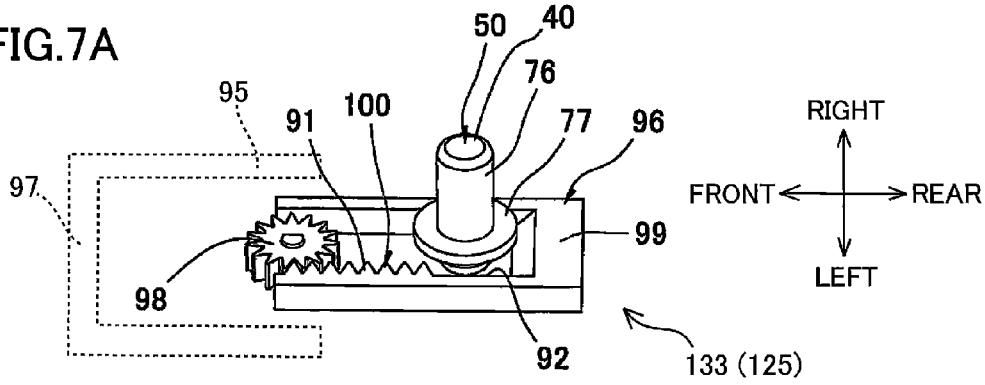

Incidentally, as shown in FIG. 7A, when the new developing cartridge 125 (not in use) is assembled into the main casing 2, the pressure member 50 is positioned at the pressure release position at a front side of the displacement portion 99 of the moving member 96.

As a result of rotation of the agitator 47, a driving force from the agitation shaft 48 is transmitted to the rack portion 100 of the moving member 96 through the pinion gear 98, so that the moving member 96 is linearly slidingly moved frontward.

Figure 7B:
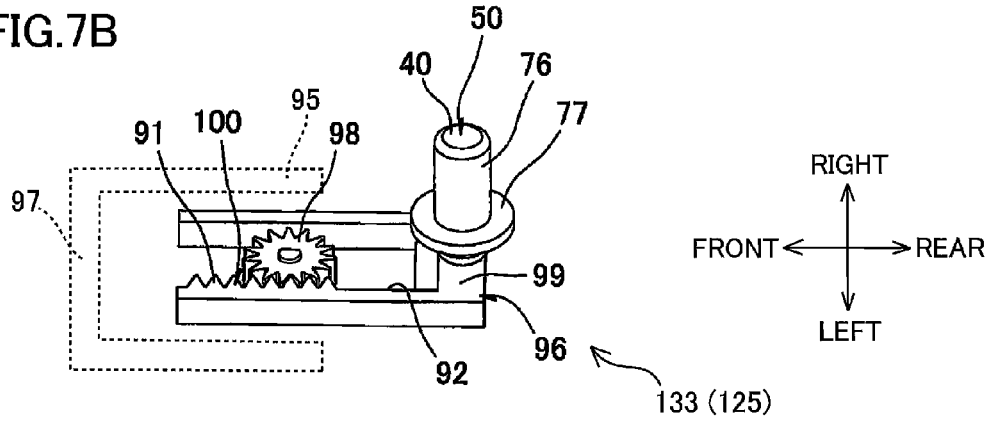

As a result, as shown in FIG. 7B, the pressure member 50 is moved rightward against the urging force of the compression spring 78 while moved along the inclined surface provided at the front end portion of the displacement portion 99, so that the pressure member 50 is seated on a right side surface of the displacement portion 99 to be positioned at the pressure position.

Accordingly, similar to the first embodiment, the developing cartridge 125 is entirely moved leftward against a pressure force from the main coupling (not shown), so that the cartridge electrode 52 is moved to the second position.

As a result of further rotation of the agitator 47, the moving member 96 is linearly slidingly moved further frontward, so that the pressure member 50 is moved to a rear side of the displacement portion 99. Thus, the pressure member 50 can be moved leftward.

Figure 7C:
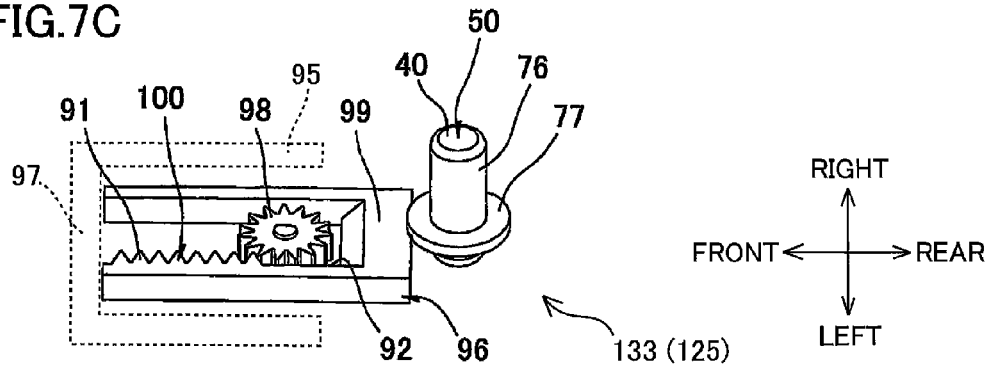

As shown in FIG. 7C, the pressure member 50 is pushed leftward by the urging force of the compression spring 78 to be moved to the pressure release position.

Accordingly, similar to the first embodiment, the developing cartridge 125 is entirely moved rightward by a pressure force from the main coupling (not shown). Consequently, the cartridge electrode 52 is moved rightward to the first position.

Further, the toothless portion 92 of the rack portion 100 is brought into confrontation with the pinion gear 98, releasing meshing engagement between the rack portion 100 and the pinion gear 98. Thus, sliding movement of the moving member 96 is stopped to terminate the warm-up operation.

(3) Operations and Effects of Second Embodiment

According to the second embodiment, as shown in FIG. 7A, the moving member 96 is linearly slidingly movable frontward.

Simple linear sliding movement of the moving member 96 can permit the cartridge electrode 52 to be moved. In other words, movement of the cartridge electrode 52 can be realized with a simple construction.

Further, according to the second embodiment, operations and effects similar to the first embodiment can also be obtained.

8. Third Embodiment

Figure 8:
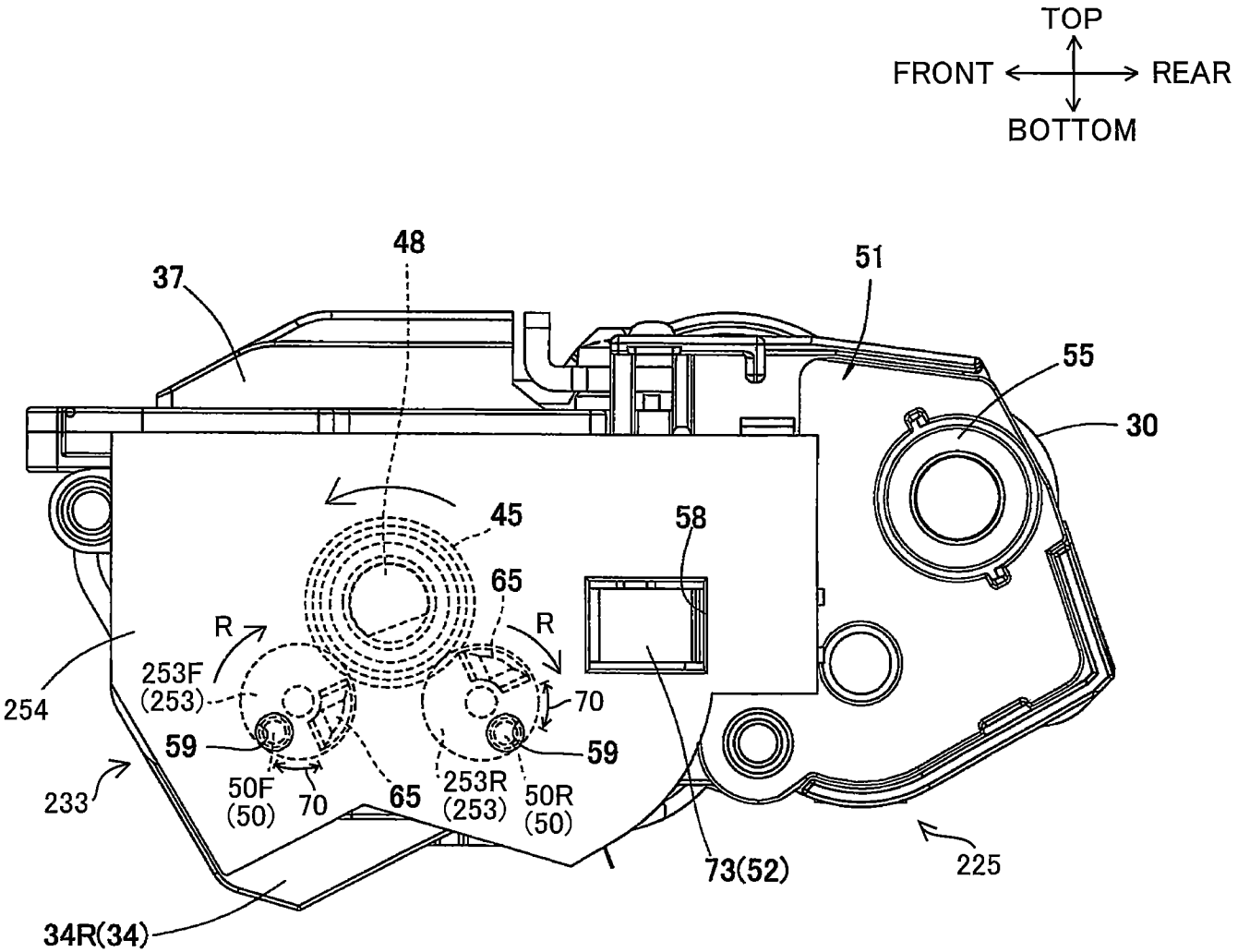
FIG. 8 is a view for description of movement of pressure members which are components of a developing cartridge according to a third embodiment of the present invention.

A developing cartridge 225 according to a third embodiment of the present invention will next be described with reference to FIG. 8 wherein like parts and components are designated by the same reference numerals as those shown in the first embodiment (FIGS. 1 through 6B) to avoid duplicating description.

(1) Structure of Third Embodiment

According to the first embodiment, the power supply unit 33 includes the single pressure member 50. However, various number of the pressure members 50 is available. For example, according to the third embodiment, the power supply unit 233 includes two pressure members 50 spaced away from each other in the frontward/rearward direction.

Similar to the pressure member 50 according to the first embodiment, each pressure member 50 according to the third embodiment is generally cylindrical shaped extending in the lateral direction.

Further, the power supply unit 233 includes two moving members 253, having a one-on-one correspondence to the two pressure members 50.

The pressure member 50 positioned at a front side will be referred to as a front pressure member 50F, and the pressure member 50 positioned at a rear side will be referred to as a rear pressure member 50R. Further, the moving member 253 positioned at a front side will be referred to as a front moving member 253F, and the moving member 253 positioned at a rear side will be referred to as a rear moving member 253R. The front moving member 253F corresponds to the front pressure member 50F, and the rear moving member 253R corresponds to the rear pressure member 50R.

In a state where the developing cartridge 225 is a new (unused) cartridge, the chipped gear 64 of the front moving member 253F is in meshing engagement with the agitator gear 45 from a lower front side thereof at the toothed portion 69. At this time, the toothless portion 70 of the chipped gear 64 of the front moving member 253F is positioned below the recessed portion 66 immediately downstream of the projection 65 of the front moving member 253F. Further, the projection 65 of the front moving member 253F is positioned in confrontation with the front pressure member 50F, and angularly spaced away from the front pressure member 50F by 30 degrees in the counterclockwise direction in a right side view.

Further, the chipped gear 64 of the rear moving member 253R is in meshing engagement with the agitator gear 45 from a lower rear side thereof at the toothed portion 69. At this time, the toothless portion 70 of the chipped gear 64 of the rear moving member 253R is positioned below the recessed portion 66 immediately downstream of the projection 65 of the rear moving member 253R. Further, the projection 65 of the rear moving member 253R is positioned in confrontation with the rear pressure member 50R, and angularly spaced away from the rear pressure member 50R by 30 degrees in the counterclockwise direction in a right side view.

Incidentally, a power supply side cover 254 of the power supply unit 233 is formed with two pressure member exposure openings 59, having a one-on-one correspondence to the two pressure members 50.

(2) Operations of Third Embodiment

Similar to the first embodiment, upon assembly of the process cartridge 11 to which the new developing cartridge 225 is assembled into the main casing 2, a warm-up operation is started, so that the agitator 47 starts rotating.

As a result of rotation of the agitator 47, a driving force from the agitation shaft 48 is transmitted to the chipped gear 64 of each moving member 253 through the agitator gear 45, so that both of the front moving member 253F and the rear moving member 253R are rotated in the clockwise direction in a right side view.

Accordingly, each pressure member 50 is seated on the projection 65 of the corresponding moving member 253 simultaneously. Thus, each pressure member 50 is positioned at the pressure position.

As a result, similar to the first embodiment, the developing cartridge 225 is entirely moved leftward against a pressure force from the main coupling (not shown). Consequently, the cartridge electrode 52 is moved leftward to the second position.

As a result of further rotation of each moving member 253 in the clockwise direction in a right side view, each pressure member 50 is displaced from the projection 65 of the corresponding moving member 253 simultaneously. Accordingly, each pressure member 50 is moved to the pressure release position.

(3) Operations and Effects of Third Embodiment

According to the third embodiment, the two pressure members 50 are in confrontation with and spaced away from each other in the frontward/rearward direction. Both pressure members 50 are moved to the pressure position simultaneously, and also moved to the pressure release position simultaneously.

Therefore, each of the front and rear pressure members 50 uniformly pushes the right side plate 43R of the drum cartridge 24 with respect to the frontward/rearward direction.

Consequently, when the developing cartridge 225 is moved leftward, balanced (uniform) movement of the developing cartridge 225 with respect to the frontward/rearward direction can be realized.

Further, according to the third embodiment, operations and effects similar to the first embodiment can be obtained.

9. Fourth Embodiment

A developing cartridge 325 according to a third embodiment of the present invention will next be described with reference to FIGS. 9A and 9B wherein like parts and components are designated by the same reference numerals as those shown in the third embodiment (FIG. 8) to avoid duplicating description.

(1) Structure of Fourth Embodiment

According to the third embodiment, the power supply unit 233 includes the two pressure members 50 and the two moving members 53 having one-on-one correspondence to the two pressure members 50. The two moving members 53 permit the corresponding pressure members 50 to be moved simultaneously. In contrast, according to the fourth embodiment, a power supply unit 333 includes two pressure members 350 and a single moving member 53. The single moving member 53 permits the two pressure members 350 to be moved simultaneously.

Figure 9A:
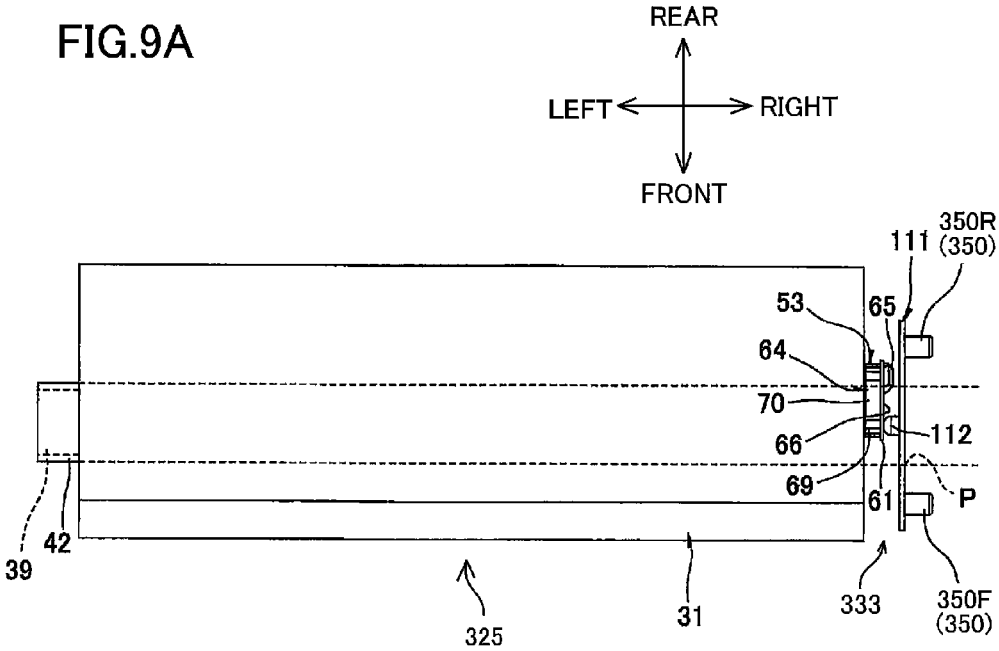
Figure 9B:
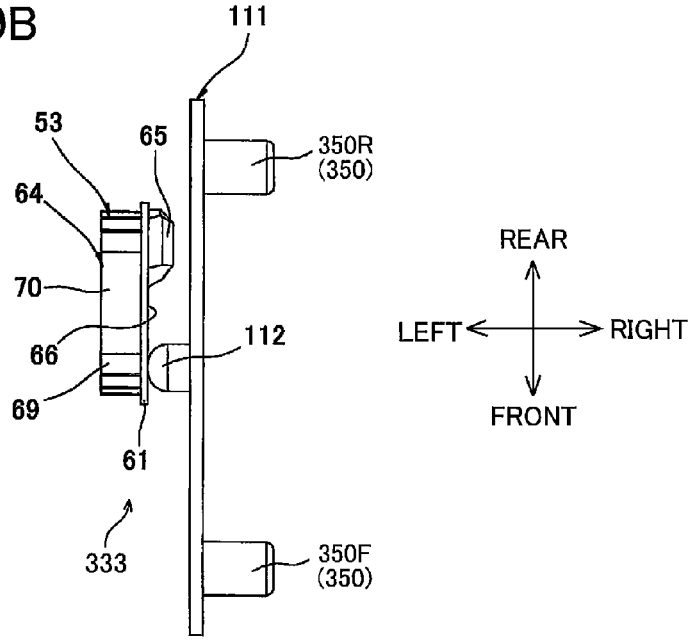

More specifically, as shown in FIGS. 9A and 9B, a connecting portion 111 is provided at the power supply unit 333 and is generally beam shaped extending in the frontward/rearward direction. Each pressure member 350 is provided at the connecting portion 111 at its front and rear end portions. The pressure member 350 positioned at the front end portion of the connecting portion 111 will be referred to as a front pressure member 350F, and the pressure member 350 positioned at the rear end portion of the connecting portion 111 will be referred to as a rear pressure member 350R. Each pressure member 350 is integral with the connecting portion 111.

When the developing coupling 39 is projected in the lateral direction (a projection plane P shown in FIG. 9A), each of the pressure members 350 is positioned such that the front pressure member 350F is positioned at a front side of the projection plane P of the developing coupling 39 while the rear pressure member 350R is positioned at a rear side of the projection plane P of the developing coupling 39, interposing the projection plane P of the developing coupling 39 between the front pressure member 350F and the rear pressure member 350R.

Further, the connecting portion 111 integrally includes an abutment portion 112. The abutment portion 112 is generally cylindrical shaped, protruding leftward from a left side surface of the connecting portion 111 at its generally center portion in the frontward/rearward direction.

In a state where the developing cartridge 325 is a new (unused) cartridge, the moving member 53 confronts the abutment portion 112 at the recessed portion 66.

(2) Operations of Fourth Embodiment

Similar to the first embodiment, upon assembly of the process cartridge 11 to which the new developing cartridge 325 is assembled into the main casing 2, a warm-up operation is started, so that the agitator 47 starts rotating.

As a result of rotation of the agitator 47, a driving force from the agitation shaft 48 is transmitted to the chipped gear 64 of the moving member 53 through the agitator gear 45, so that moving member 53 is rotated.

When the abutment portion 112 is seated on the projection 65 of the moving member 53, both pressure members 350 are integrally moved to the pressure position.

As a result, similar to the first embodiment, the developing cartridge 325 is entirely moved leftward against a pressure force from the main coupling (not shown). Consequently, the cartridge electrode 52 is moved leftward to the second position.

As a result of further rotation of the moving member 53, the abutment portion 112 is displaced from the projection 65 to confront the recessed portion 66. Accordingly, both pressure members 350 are integrally moved to the pressure release position.

(3) Operations and Effects of Fourth Embodiment

According to the fourth embodiment, operations and effects similar to the third embodiment can be obtained.

10. Fifth Embodiment

A developing cartridge 425 according to a fourth embodiment of the present invention will next be described with reference to FIGS. 10 through 11B wherein like parts and components are designated by the same reference numerals as those shown in the first embodiment (FIGS. 1 through 6B) to avoid duplicating description.

(1) Structure of Fifth Embodiment

According to the first embodiment, movement of the cartridge electrode 52 is detected by the photo-sensor 83 through the main electrode 81 and the actuator 82, and determination is made on the CPU 84 as to whether or not the developing cartridge 25 is assembled, and whether or not the assembled cartridge 25 is a new cartridge.

Figure 10:
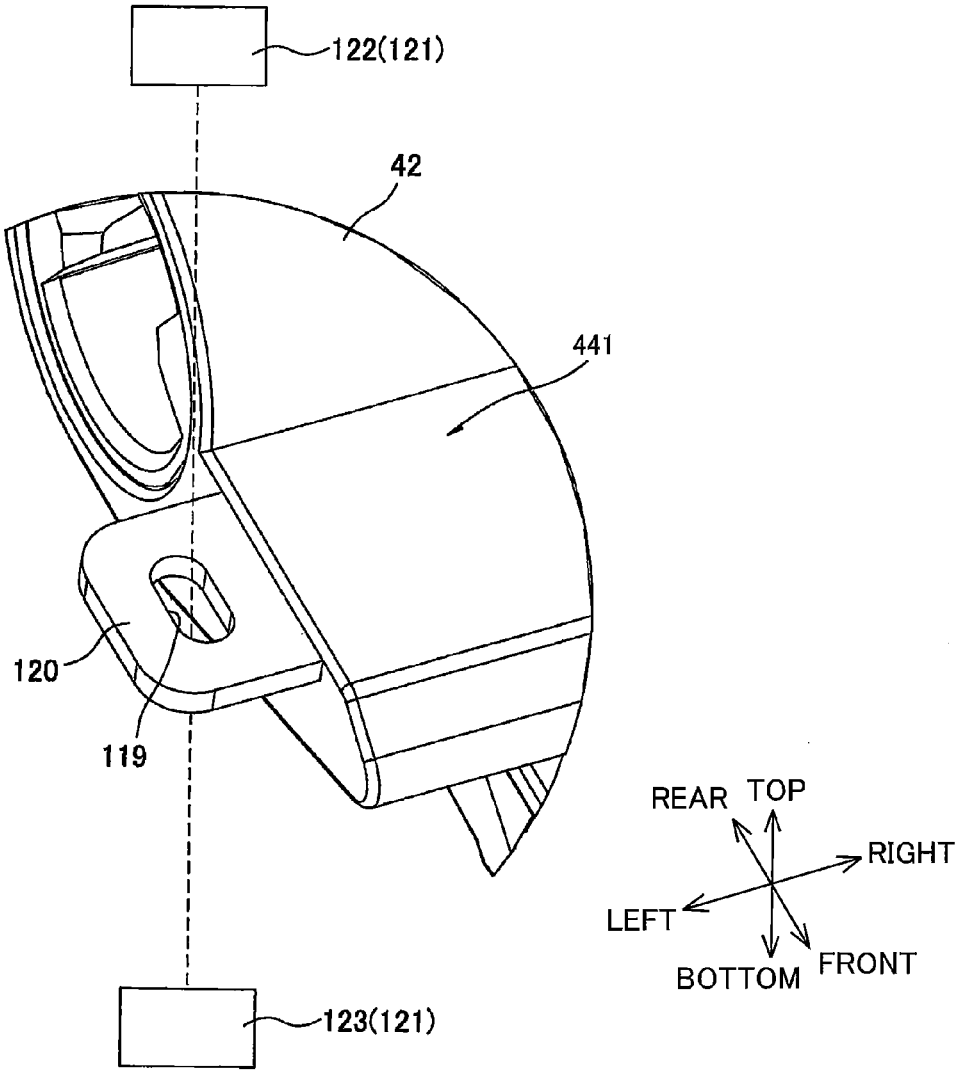
FIG. 10 is a view for description of a developing cartridge according to a fifth embodiment of the present invention.

On the other hand, according to the fifth embodiment, a light shielding plate 120 is provided at a drive side cover 441 for shielding a detection light of a photo-sensor 121 as shown in FIG. 10. Thus, movement of the light shielding plate 120 in association with movement of the developing cartridge 425 can be detected by the photo-sensor 121, so that determination can be made on the CPU 84 as to whether or not the developing cartridge 425 is assembled, and whether or not the assembled cartridge 425 is a new cartridge.

More specifically, the light shielding plate 120 is flat plate shaped, and is positioned at a front end portion of the drive side cover 441. Further, the light shielding plate 120 protrudes leftward from a left side surface of the drive side cover 441. The light shielding plate 120 has an intermediate portion in the lateral direction formed with an elongated slot 119 extending in the frontward/rearward direction.

The photo-sensor 121 is positioned adjacent to the left side of the developing cartridge 425, and includes a light emitting element 122 for emitting the detection light, and a light receiving element 123 for receiving the detection light. The light emitting element 122 and the light receiving element 123 are arrayed in vertical direction and spaced away from each other such that the light shielding plate 120 is positioned therebetween. The photo-sensor 121 is positioned so as to allow the detection light to pass through the elongated slot 119 when the developing cartridge 425 is moved leftward as a result of the pressure member 50 being positioned to the pressure position.

(2) Operation of Fifth Embodiment

According to the fifth embodiment, the detection light emitted from the light emitting element 122 is received in the light receiving element 123 when the process cartridge 11 (the developing cartridge 425) has not been assembled to the main casing 2. Accordingly, the photo-sensor 121 transmits an ON signal to the CPU 84.

Upon elapsing a predetermined time period with reception of the detection light at the light receiving element 123, in other words, if the ON signal from the photo-sensor 121 is not interrupted within the predetermined time period, the CPU 84 determines that the developing cartridge 425 is not assembled to the main casing 2.

Figures 11A, 11B:
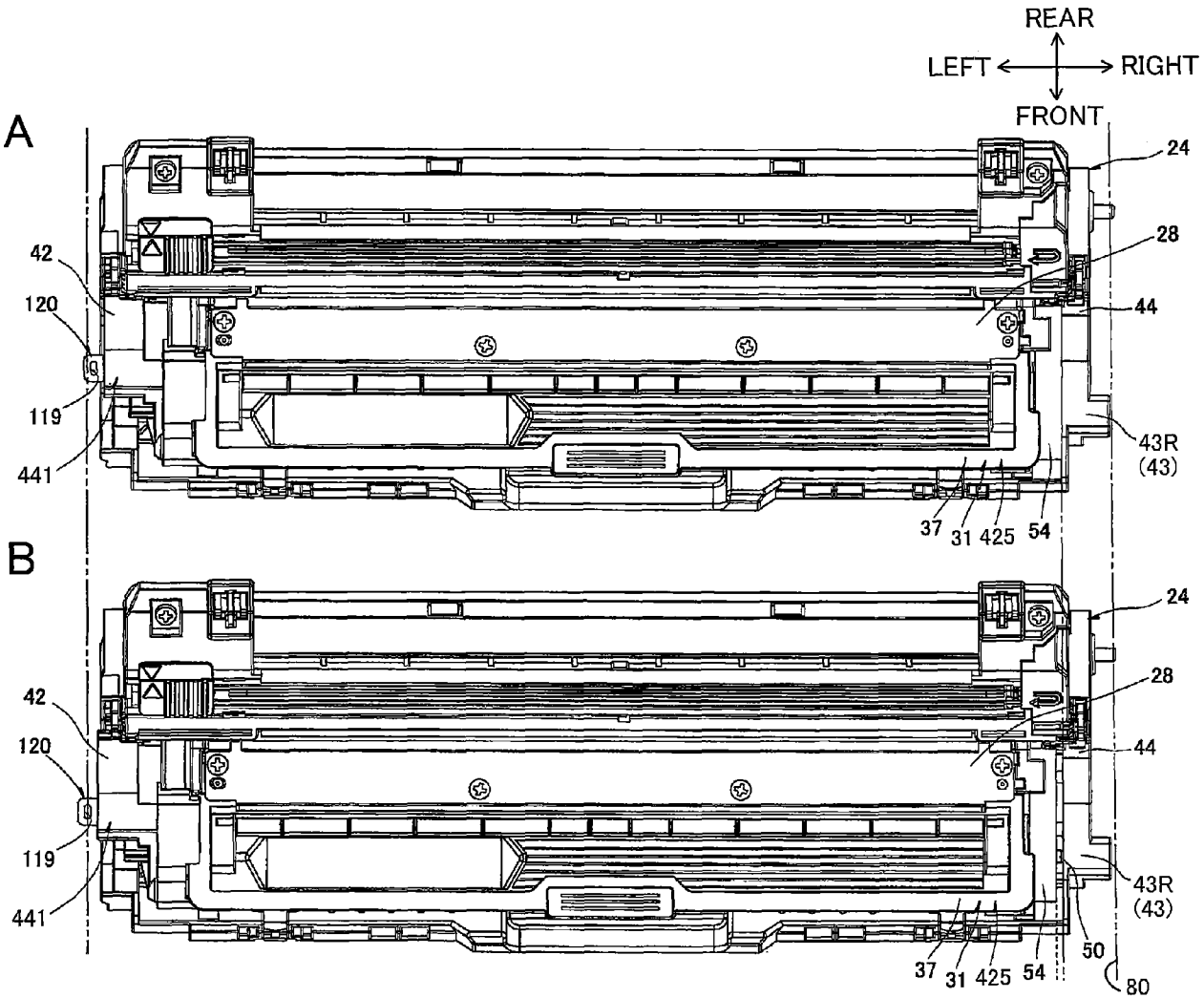

Then, when the top cover 6 of the main casing 2 is opened to insert, from diagonally above and frontward into the main casing 2, the process cartridge 11 to which a new (unused) developing cartridge 425 is assembled, the detection light of the photo-sensor 121 is interrupted at the left end portion of the light shielding plate 120 as shown in FIG. 11A.

Thus, output of the ON signal from the photo-sensor 121 to the CPU 84 is interrupted. That is, the photo-sensor 121 detects a first position of the light shielding plate 120.

Then, the CPU 84 determines that the developing cartridge 425 has been assembled to the main casing 2 when the ON signal from the photo-sensor 121 is interrupted within a predetermined time period.

Similar to the first embodiment, the main coupling (not shown) in the main casing 2 is fitted with the developing coupling 39 of the drive unit 32, preventing relative rotation therebetween after the assembly of developing cartridge 425 into the main casing 2.

Then, the developing cartridge 25 is pushed rightward by the main coupling (not shown), and is subjected to positioning relative to the right side plate 43R of the drum cartridge 24. At the same time, the right side plate 43R of the drum cartridge 24 is subjected to positioning relative to the right side wall 80 of the main casing 2.

Thus, a driving force from the main casing 2 is transmitted to the developing coupling 39 through the main coupling (not shown) for starting a warm-up operation.

Then, as shown in FIG. 11B, the pressure member 50 is positioned to the pressure position such that the right end portion of the shaft portion 76 protrudes rightward through the pressure member exposure opening 59 of the power supply side cover 54 against the biasing force of the compression spring 78.

Accordingly, the pressure member 50 presses against the inner surface of the right side plate 43R of the drum cartridge 24 at the right end portion of the shaft portion 76.

Then, the right end portion of the pressure member 50 is pressed leftward by the reaction force from the right side plate 43R of the drum cartridge 24, whereupon the developing cartridge 425 is entirely moved leftward against a pressure force from the main coupling (not shown). Consequently, the light shielding plate 120 is moved leftward to a second position.

Then, the detection light from the light emitting element 122 passes through the elongated slot 119 of the light shielding plate 120 and is received in the light receiving element 123.

Thus, the photo-sensor 121 transmits an ON signal to the CPU 84. That is, the photo-sensor 121 detects the second position of the light shielding plate 120.

Then, the CPU 84 determines that the light shielding plate 120 has been moved from the first position to the second position upon receipt of the ON signal from the photo-sensor 121.

Then, when the pressure plate 50 is moved to the pressure release position after the warm-up operation has been terminated, the pressure member 50 does not any more press against the right side plate 43R of the drum cartridge 24.

Then, the developing cartridge 425 is pushed rightward by the main coupling (not shown), thereby again being subjected to positioning relative to the right side plate 43R of the drum cartridge 24. Consequently, the cartridge electrode 52 is moved rightward to the first position.

Then, the detection light from the light emitting element 122 is blocked by the left end portion of the light shielding plate 120.

Accordingly, output of the ON signal from the photo-sensor 121 to the CPU 84 is interrupted. That is, the photo-sensor 121 detects the first position of the light shielding plate 120.

Due to the interruption of the ON signal from the photo-sensor 121, the CPU 84 determines that the light shielding plate 120 has been moved from the second position to the first position.

Then, the CPU 84 determines that the developing cartridge 425 is a new (unused) cartridge based on the detection of movement of the light shielding plate 120 from the first position to the second position and then from the second position to the first position after starting the warming-up operation.

(3) Operations and Effects of the Fifth Embodiment

According to the fifth embodiment, operations and effects similar to the first embodiment can also be obtained.

11. Modifications

According to the fifth embodiment, the elongated slot 119 extending in the frontward/rearward direction is positioned at the laterally intermediate portion of the light shielding plate 120. However, various shape of the light shielding plate 120 is available as long as the light shielding plate 120 can block the detection light directed toward the light receiving element 123.

Figure 12A:
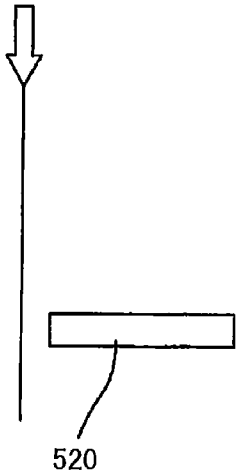
Figure 12B:
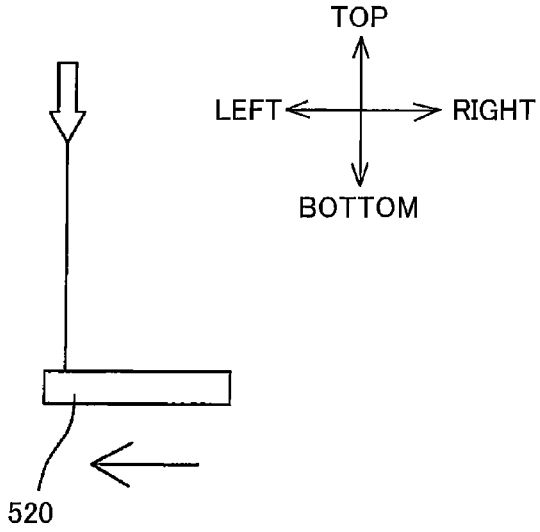

For example, a light shielding plate 520 is a solid plate without the elongated slot 119. In this case, as shown in FIG. 12A, the light shielding plate 520 is retracted rightward relative to an optical path of the detection light when the light shielding plate 520 is positioned at the first position, i.e., when the developing cartridge 25 is subjected to positioning relative to the right side plate 43R of the drum cartridge 24. Further, as shown in FIG. 12B, the light shielding plate 520 blocks the detection light when the light shielding plate 520 is positioned at the second position, i.e., when the developing cartridge 25 is moved leftward against the pressure force from the main coupling (not shown).

Figure 13A:
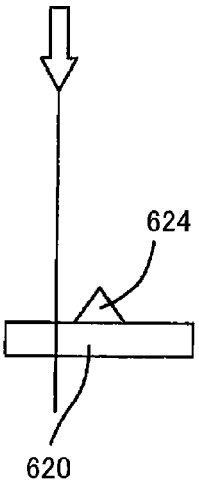
Figure 13B:
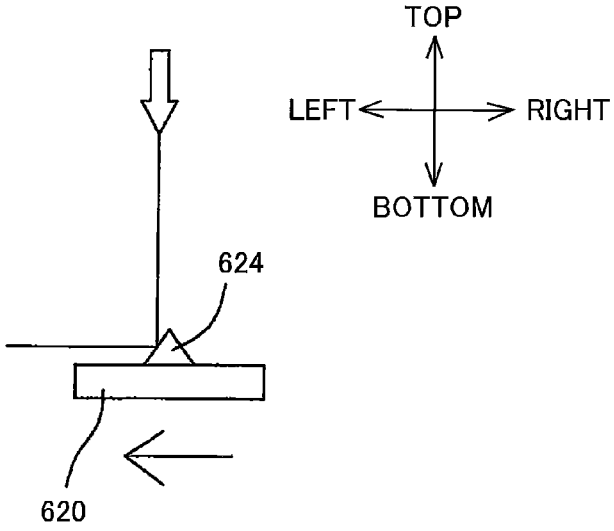

Alternatively, a light transmission plate 620 can be used instead of the light shielding plate 120. More specifically, as shown in FIGS. 13A and 13B, a reflection mirror 624 is provided at the light transmission plate 620 which allows the detection light to pass therethrough. In the first position, the detection light passes through the light transmission plate 620 as shown in FIG. 13A, and in the second position, the detection light is reflected at the reflection mirror 624 as shown in FIG. 13B.

Further, according to the first embodiment, the developing cartridge 25 is pushed rightward because of fitting engagement of the main coupling (not shown) with the developing coupling 39 from a left side thereof, thereby being subjected to positioning relative to the right side plate 43R.

Figure 14:
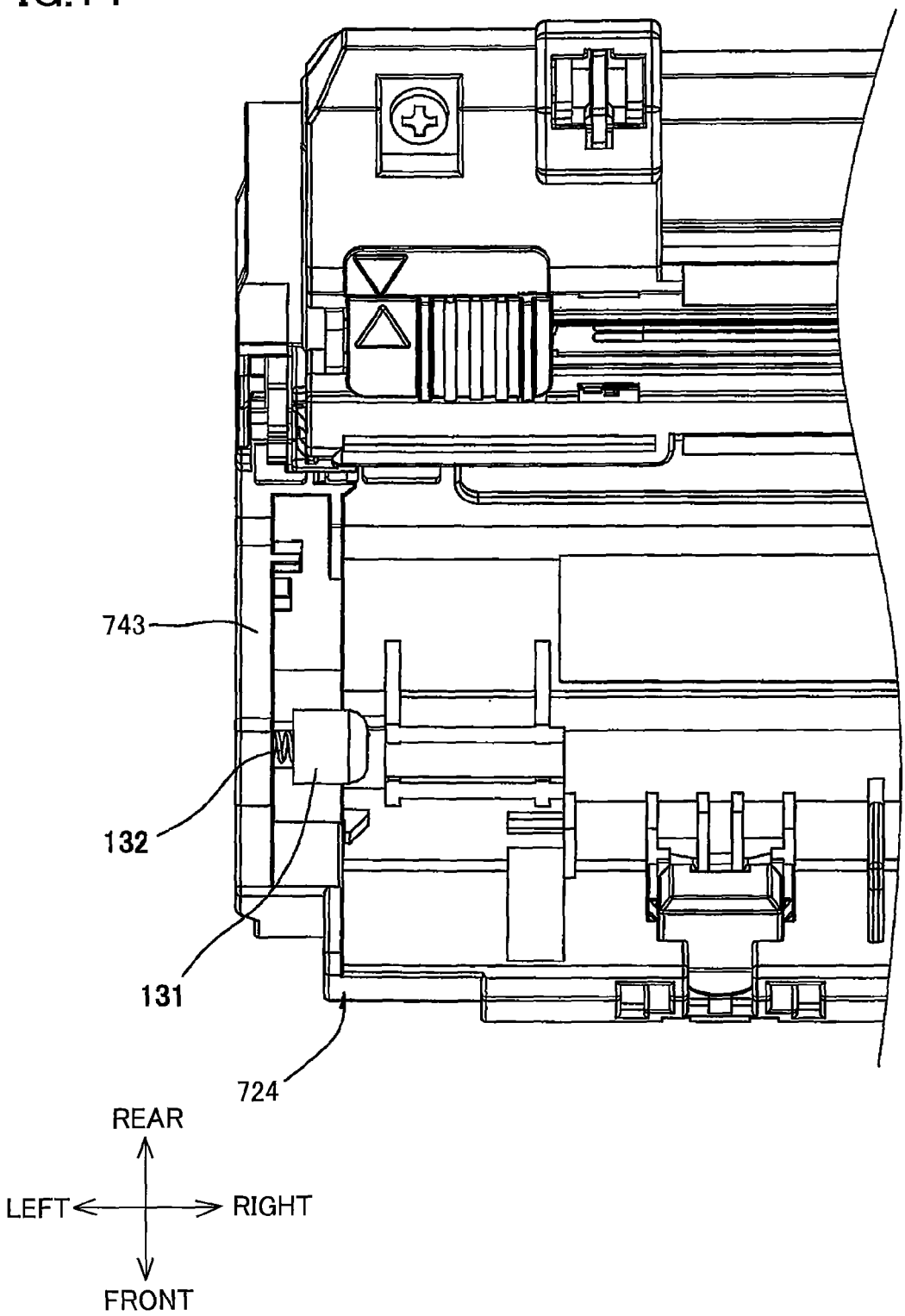
FIG. 14 is a view for description of a modification of a structure configured to push a developing cartridge rightward, in which an abutment member configured to urge the developing cartridge rightward is provided at a side wall of a drum cartridge.

However, any component is available for pushing the developing cartridge 25 rightward. For example, as shown in FIG. 14, an abutment member 131 can be provided in an inner surface of the left side plate 743 of the drum cartridge 724, and a compression spring 132 is provided for urging the abutment member 131 rightward. Thus, the developing cartridge 25 can be pushed rightward by the urging force of the compression spring 132.

Further, according to the first embodiment, the pressure member 50 and the moving member 53 are positioned at a right side of the developing cartridge 25. However, these can be positioned at a left side of the developing cartridge 25 yet obtaining the effect same as that of the first embodiment.

Further, according to the first embodiment, the pressure member 50 presses against the inner surface of the right side plate 43R of the drum cartridge 24. However, the pressure member can press an inner wall (not shown) of the main casing 2 to provide the advantage the same as that of the first embodiment.

While the present invention has been described in detail with reference to the embodiments thereof, it would be apparent to those skilled in the art that various changes and modifications may be made therein without departing from the spirit of the present invention.

What is claimed is:

1. An image forming apparatus comprising:

a main casing;

a cartridge configured to be attached to and detached from the main casing and to accommodate therein developing agent;

a pressed portion positioned outside of the cartridge;

a detection unit positioned in confrontation with the cartridge in a confronting direction and configured to detect a position of the cartridge; and a processing unit configured to determine that a cartridge attached to the main casing is a new cartridge based on a detection of the detection unit, the cartridge comprising:

a detected portion configured to be detected by the detection unit, the detected portion configured to be moved to a first position and to a second position moved from the first position in the confronting direction;

a pressure member configured to press against the pressed portion and to be moved to a pressure position where the detected portion is moved to the second position by a reaction force in response to a pressure force from the pressure member against the pressed portion and to a pressure release position where the reaction force applied to the pressed portion is released to permit the detected portion to be moved to the first position; and a moving member configured to be moved in a moving direction by a predetermined moving amount, the moving member being configured to move the pressure member to the pressure position and to the pressure release position, wherein the processing unit determines that the cartridge attached to the main casing is a new cartridge if the detection unit detects a movement of the detected portion, wherein the detected portion includes a cartridge electrode configured to receive electric power from the main casing, and wherein the detection unit includes a main electrode configured to be electrically connected to the cartridge electrode and moved in the confronting direction, and wherein the processing unit determines that a cartridge attached to the main casing is a new cartridge if the main electrode is moved in accordance with the movement of the detected portion between the first position and the second position.

2. The image forming apparatus as claimed in claim 1, wherein the processing unit determines that the cartridge has been attached to the main casing if the detection unit detects within a predetermined period of time a position of the main electrode when the cartridge electrode is at the first position, and that the cartridge has been detached from the main casing if the detection unit does not detect within a predetermined period of time a position of the main electrode when the cartridge electrode is at the first position.

3. The image forming apparatus as claimed in claim 1, wherein the confronting direction includes a first confronting direction and a second confronting direction opposite to the first confronting direction; and wherein the pressure member has one surface at a downstream side thereof in the first confronting direction, the one surface extending in an orthogonal direction orthogonal to the confronting direction.

4. The image forming apparatus as claimed in claim 1, wherein the confronting direction includes a first confronting direction and a second confronting direction opposite to the first confronting direction; and wherein the moving member is provided with a projection protruding in the first confronting direction while defining a recessed portion recessed in the second confronting direction, the projection defining an inclined surface that is inclined in the first confronting direction toward an upstream side in the moving direction of the moving member with respect to the pressure member.

5. The image forming apparatus as claimed in claim 1, wherein the moving member is provided with a partially toothless gear comprising a toothed portion to which a driving force from the main casing is transmittable, and a toothless portion prohibiting transmission of the driving force.

6. The image forming apparatus as claimed in claim 5, wherein the moving member is rotatable in a rotating direction, the moving direction of the moving member being the rotating direction.

7. The image forming apparatus as claimed in claim 5, wherein the moving member is linearly movable.

8. The image forming apparatus as claimed in claim 5, wherein the pressure member is at the pressure release position prior to transmission of the driving force to the toothed portion, and moved from the pressure release position to the pressure position and then moved from the pressure position to the pressure release position upon transmission of the driving force to the toothed portion.

9. The image forming apparatus as claimed in claim 1, wherein the cartridge further comprises an urging member configured to urge the pressure member so that the pressure member is brought into the pressure release position.

10. The image forming apparatus as claimed in claim 1, wherein the confronting direction includes a first confronting direction and a second confronting direction opposite to the first confronting direction, the confronting direction being orthogonal to an orthogonal direction, the orthogonal direction including a first orthogonal direction and a second orthogonal direction opposite to the first orthogonal direction;

wherein the cartridge further comprises a drive input portion configured to receive a driving force from the main casing, the drive input portion being provided at one of a downstream side and an upstream side of the cartridge in the first confronting direction; and wherein the pressure member includes a first pressure member and a second pressure member, the first pressure member being positioned at an upstream side of the second pressure member in the first orthogonal direction such that the drive input portion is positioned between the first pressure member and the second pressure member in the first orthogonal direction when projected in the confronting direction.

11. A cartridge comprising:

a cartridge frame configured to accommodate therein developing agent, the cartridge frame including a first side wall and a second side wall spaced away therefrom and in confrontation therewith in a confronting direction;

a drive input portion provided at one of the first side wall and the second side wall and configured to receive an external driving force;

a detected portion provided at one of the first side wall and the second side wall and configured to be detected by an external detection unit, the detected portion configured to be moved to a first position and to a second position moved from the first position in the confronting direction;

a pressure member provided at the second side wall and configured to press against an external pressed portion, the pressure member configured to be moved to a pressure position where the detected portion is moved to the second position by a reaction force in response to a pressure force from the pressure member against the external pressed portion and to a pressure release position where the reaction force applied to the external pressed portion is released to permit the detected portion to be moved to the first position; and a moving member provided at the second side wall and configured to be moved in a moving direction by a predetermined moving amount upon transmission of a driving force inputted in the drive input portion, the moving member being configured to move the pressure member to the pressure position and to the pressure release position, wherein the detected portion includes a cartridge electrode configured to receive external electric power.

12. The cartridge as claimed in claim 11, wherein the confronting direction includes a first confronting direction and a second confronting direction opposite to the first confronting direction; and wherein the pressure member has one surface at a downstream side thereof in the first confronting direction, the one surface extending in an orthogonal direction orthogonal to the confronting direction.

13. The cartridge as claimed in claim 11, wherein the confronting direction includes a first confronting direction and a second confronting direction opposite to the first confronting direction; and wherein the moving member is provided with a projection protruding in the first confronting direction while defining a recessed portion recessed in the second confronting direction, the projection defining an inclined surface that is inclined in the first confronting direction toward an upstream side in the moving direction of the moving member with respect to the pressure member.

14. The cartridge as claimed in claim 11, wherein the moving member is provided with a partially toothless gear comprising a toothed portion to which a driving force from the drive input portion is transmittable, and a toothless portion prohibiting transmission of the driving force.

15. The cartridge as claimed in claim 14, wherein the moving member is rotatable in a rotating direction, the moving direction of the moving member being the rotating direction.

16. The cartridge as claimed in claim 14, wherein the moving member is linearly movable.

17. The cartridge as claimed in claim 14, wherein the pressure member is at the pressure release position prior to transmission of the driving force to the toothed portion, and moved from the pressure release position to the pressure position and then moved from the pressure position to the pressure release position upon transmission of the driving force to the toothed portion.

18. The cartridge as claimed in claim 11, further comprising an urging member configured to urge the pressure member so that the pressure member is brought into the pressure release position.

19. The cartridge as claimed in claim 11, wherein the confronting direction includes a first confronting direction and a second confronting direction opposite to the first confronting direction, the confronting direction being orthogonal to an orthogonal direction, the orthogonal direction including a first orthogonal direction and a second orthogonal direction opposite to the first orthogonal direction; and wherein the pressure member includes a first pressure member and a second pressure member, the first pressure member being positioned at an upstream side of the second pressure member in the first orthogonal direction such that the drive input portion is positioned between the first pressure member and the second pressure member in the first orthogonal direction when projected in the confronting direction.

* * * * *